United States Patent [19]

Myers et al.

[11] Patent Number: 5,022,983

[45] Date of Patent: Jun. 11, 1991

[54] PROCESS FOR CLEANING OF COAL AND SEPARATION OF MINERAL MATTER AND PYRITE THEREFROM, AND COMPOSITION USEFUL IN THE PROCESS

[75] Inventors: Cal Y. Myers, Carbondale; Richard B. Read, Champaign, both of Ill.

[73] Assignee: Southern Illinois University Foundation, Carbondale, Ill.

[21] Appl. No.: 395,014

[22] Filed: Aug. 17, 1989

Related U.S. Application Data

[63] Continuation of Ser. No. 81,140, Aug. 3, 1987, abandoned.

[51] Int. Cl.[5] ..... B03D 1/02

[52] U.S. Cl. ..... 209/167; 209/166; 252/61

[58] Field of Search ..... 209/166, 167; 252/61

[56] References Cited

U.S. PATENT DOCUMENTS

| | | | |
|---|---|---|---|
| 2,074,699 | 3/1937 | Lenher | 209/166 |
| 2,102,370 | 12/1937 | Merriss | 209/166 |
| 2,112,362 | 3/1938 | Gillson | 209/166 |
| 2,120,217 | 6/1938 | Harris | 209/166 |
| 2,346,151 | 4/1944 | Burk | 209/166 |
| 3,394,893 | 7/1968 | Moss | 209/166 |
| 4,199,065 | 4/1980 | Wang | 209/166 |
| 4,308,133 | 12/1981 | Meyer | 209/166 |
| 4,830,740 | 5/1989 | Klinpel | 209/167 |

FOREIGN PATENT DOCUMENTS

| | | | |
|---|---|---|---|
| 125488 | 3/1980 | Japan | 209/166 |
| 609131 | 9/1948 | United Kingdom | 209/166 |
| 2163975 | 3/1986 | United Kingdom | 209/166 |
| 2175226 | 11/1986 | United Kingdom | 209/166 |

OTHER PUBLICATIONS

"Optimizing Coal Cleaning/Pyrite Removal of the use of Cis-Dialkylethelene Sulfonate Reagents", Quarterly Technical Report for Center for Research on Sulfur in Coal (CRSC).

Preceedigns, 1st Annular Pittsburgh Coal Conference, Sep. 17-21, 1984, "A Preliminary Investigation on the Application of Colloidal Gas Aphrons for the Coal Cleaning", by Yoon and Miller.

"The Effect of Bubble Size on Fine Coal Flotation", Coal Preparation, 1986, vol. 2, pp. 179-192.

*Primary Examiner*—Stanley Silverman

*Assistant Examiner*—Krisanne Shideler

*Attorney, Agent, or Firm*—Senniger, Powers, Leavitt & Roedel

[57] ABSTRACT

A flotation process is disclosed for cleaning of particulate coal and separation therefrom of pyrite and ash. A flotation pulp is prepared comprising a particulate coal feed material and an anionic surfactant selected from among alkanesulfonic acids, alkenesulfonic acids, alkynesulfonic acids, arenesulfonic acids, alkyl sulfuric acids, alkenyl sulfuric acids, alkynyl sulfuric acids, aryl sulfuric acids and salts of these acids. Among the particularly preferred surfactants are substituted ethenesulfonic acids and salts thereof. Other preferred embodiments include the use of at least about 0.3 pound surfactant per ton of particulate feed material; implementation of the process via aggregate flotation, in which at least about 50% by weight of the particulate coal feed material is smaller than about 400 mesh; and use of combinations of anionic surfactants and nonionic frothing agents. A novel composition of matter comprising the anionic surfactants and a nonionic compound is also disclosed.

35 Claims, 14 Drawing Sheets

ANIONIC AS
FRACTION OF
TOTAL
REAGENT

PROCESS FOR CLEANING OF COAL AND SEPARATION OF MINERAL MATTER AND PYRITE THEREFROM, AND COMPOSITION USEFUL IN THE PROCESS

This is a continuation of application Ser. No. 081,140, filed Aug. 3, 1987, now abandoned.

BACKGROUND OF THE INVENTION

This invention relates to the field of coal beneficiation, and more particularly to an improved flotation process for cleaning of coal and separation of pyrite therefrom.

Naturally occurring coal contains mineral matter impurities such as clays, shales and iron pyrite ($FeS_2$) which are detrimental to use of coal for the production of clean, efficient energy. When coal is burned for the production of steam, minerals such as clay and shales form ash which builds up and fouls boilers. During combustion, pyrite releases sulfur which is discharged into the atmosphere as sulfur dioxide. Sulfur dioxide is not only a major local pollutant in itself, but may be precipitated as sulfuric or sulfurous acid rain in locations remote from the emission source.

Some of the mineral matter in coal is present in cleat form, or as fairly large particles. These relatively large pieces of mineral matter are readily removed from coal by processes based on the difference in density between the mineral matter and the carbonaceous matter of the coal. Hence, traditional gravity processes such as jigs or shaking tables may be employed. However, some of the mineral matter in coal is present in finely disseminated form. In order to liberate such fine mineral particules, the coal must be ground to a very fine size. When the particle size of coal is reduced to below 28 mesh or 0.7 mm, commonly referred to as "fine coal", gravity processes become ineffective for separation of pyrite and other minerals from the carbonaceous matter of the coal. However, coal whose particle size has been reduced to this point exhibits surface properties that may provide a basis for separation of carbonaceous from mineral matter.

One separation process based on surface properties is froth flotation. In this process, particulate coal is mixed as a slurry with water, and a collector such as kerosene is added in dosages typically of about 0.5–3 pounds per ton of coal. Such a collector makes the surface of the coal more hydrophobic. After the coal slurry containing the collector is conditioned by agitation to assure good phase contact, a frothing agent is added in small amounts to the slurry, producing a flotation pulp which is charged to a flotation cell into which air is also introduced. Air is sparged into the bottom of the cell, producing bubbles which typically range in size from 0.2 to 3 mm. Hydrophobic carbonaceous particles of the coal adhere to the air bubbles and rise with the bubbles to the upper surface of the liquid as a coal laden froth. The mineral matter, which is largely hydrophilic, remains in suspension, and a separation is thus effected.

Although the process of coal flotation is well established for coal fines having an average particle size generally smaller than of 28 mesh, such processes are generally effective only for cleaning of the coal and separation of ash therefrom. Particles of pyrite contained within the coal fines are generally of such small size as to be embedded within the carbonaceous matter, and thus are not effectively separated from 28 mesh or $28\times100$ mesh material. Conditions may be adjusted to concentrate more of the pyrite in the tailings, but this depresses the weight yield and energy value recovery of the carbonaceous matter of the coal. Thus, there is a conflict, or trade off, between energy value recovery and sulfur content of the coal flotation product. To an extent this may be compensated for by using higher dosages of frothing agent, but effective pyrite separation at satisfactory BTU recovery is elusive.

Even the conventional function of cleaning $28\times100$ mesh coal and separation of ash therefrom consumes substantial unit amounts of conventional frothers. Among the frothing agents which are known for coal flotation are pine oil, cresols, isomers of amyl alcohol and other branched $C_4$ to $C_8$ alkanols, methylisobutylcarbinol, diisobutyl carbinol 2-ethyl-1-hexanol and polypropylene glycol alkyl or phenyl ethers.

One method for unlocking pyrite enclosed in coal particles is extensive comminution to ultrafine sizes (as fine as 400 mesh). However, this procedure yields a coal product which can be difficult to separate from ash or pyrite by either wet or dry processes, and which may consume particularly high unit volumes of frothing agent if separation by flotation is attempted. Where coal has been comminuted to ultra fine size, the hydrophilic particles may be carried into the froth in layers of water attached to the air bubbles, and the large specific surface of the fine particles generally requires large reagent dosages. Moreover, the influence of surface and electrochemical properties is magnified in utlrafine coal particles, so that the flotation characteristics of fines differ from those of coarser counterparts of the same material.

Efforts have been made in the art to develop processes effective for separation of carbonaceous matter from pyrite and other mineral content of ultrafine coal. Wet processes for such purpose include oil agglomeration, selective flocculation, and coal reverse-pyrite flotation, while dry processes such as high gradient magnetic separation have also been attempted. All these processes have been reportedly successful in reducing pyritic sulfur in coal. However, such processes have not met with a great deal of commercial success because they require extensive retrofitting for implementation in existing plants, and generally have not been proven by full scale process testing.

Because flotation processes have been extensively operated on a commercial scale and there is substantial installed flotation capacity within the coal processing industry, an improved flotation process would potentially provide the most attractive alternative for separation of pyrite and other mineral matter from coal. However, in addition to the problems mentioned above, attempts to process ultrafine coal by flotation are confronted with other difficulties. In a flotation process, the coal particle must first collide with a rising air bubble; then surface interactions must be such that the particle adheres to the air bubble as it rises to the collection zone. Decrease in recovery efficiency with decrease in solid particle size is attributable in part to the reduced probability of bubble/particle collision. The probability that a particle and bubble will collide is adversely affected by factors such as small size, low mass-to-size ratio, surface charges of the particles, and streamlines around the flotation bubble.

Additionally, reagent selectivity, which is based on hydrophobic/hydrophilic interactions between the flotation reagent and the coal surface in an aqueous environment, can significantly influence the overall effectiveness of the flotation process. Adhesion of particles to bubbles is affected not only by these interactions but also by the natural hydrophobicity of the coal particle, induction time requirements, competitive rates of bubble growth, and coalescence and surface tension.

There has been some recognition in the art that bubble size is desirably proportioned to coal particle size. Accordingly, attempts to control the rate of flotation by employing microbubbles have been reported for ultrafine size coal Yoon, "Microbubble Flotation of Fine Coal", Department of Mining and Minerals Engineering, Virginia Polytechnic Institute, Blacksburg, Virginia (1984) reports a study in which introduction of externally generated microbubbles into a column of ultrafine coal yielded improved recovery in product quality as compared to conventional subaeration cells. Jameson et al. (1977) also report work on the concept of microbubble flotation, indicating that advantage may be taken of differences in particle and bubble diameter dependency However, as noted above, as particle size become smaller the specific surface area increases significantly and surface charges and chemical interactions with the reagent become important. It has not been shown that microbubbles in and of themselves can completely control effective flotation of ultrafine coal. Thus, a need has remained for improved processes effective for the flotation of ultrafine coal and particularly for the effective separation of pyrite therefrom, using conventional flotation installations.

Various technologies have been available in the flotation art generally for separation of very fine particles. Thus, for example, Seeton, "Ultraflotation of Minerals and Chemicals", Phillips Corporation Bulletin Number M4-B117, describes a process referred to as "carrier flotation" or "ultraflotation", in which fine particles of the mineral to be recovered are attached to larger particles of a carrier mineral and the resultant aggregates are coated using suitable reagents. This process has been used commercially for the purification of kaolin in which titaniferous impurities are removed from kaolin clay using 60 micron limestone as the carrier particle. However, carrier flotation solves one problem only by creating another, i.e., the need for separation of the desired product from the carrier mineral.

Narasemhan et al, "Column Flotation Improves Graphite Recovery", Engineering and Mining Journal, Volume 84, May, 1972, describes a technique of column flotation which utilizes countercurrent flow to improve separations in a flotation process. In the flotation column, air bubbles rise continuously through a downward flowing slurry, in the course of which bubbles are mineralized and washed free of entrapped gangue particles. The flotation bubbles are smaller than those used in a conventional flotation cell, and column flotation is most effective for particles below 100 mesh.

Dissolved air flotation is widely used for waste water treatment. In accordance with this process, air is dissolved in the water under pressure and, upon release of the pressure, the dissolved air forms a cloud of tiny bubbles which collect and float off impurities. In a similar process, known as microflotation, air is forced through a frit into liquid that has been treated with a surface-tension reducing agent, thus forming tiny bubbles capable of floating particulate matter from waste water. Flocculating ions may also be added so that flocs are formed incorporating into their structure any bacteria or microparticles present. However, dissolved air and microflotation are designed for flotation of all suspended matter, and have not been developed for selective flotation of a desired component.

Because oil/solid interactions due to long range intermolecular forces are much larger than air/solid interactions, it is easier to collect fine particles at an oil/water interface than at an air/water interface. Processes such as oil agglomeration which take advantage of this phenomenon may be termed a form of liquid/liquid extraction. This process has been applied to coal recovery but requires a great deal of oil, for example, from 5–25% by weight on a dry coal basis. Incorporation of air, in which case the process is referred to as emulsion flotation, may help reduce the requisite oil dosage. However, even the latter process requires consumption of a substantial volume of oil, generally rendering the process uneconomical.

In processes known as agglomerate flotation, floto flocculation or aggregative flotation, small particles of a desired mineral are first aggregated and then floated with air bubbles. The larger agglomerates are floated at a rate more rapid than discrete fine particles. Aggregative flotation relies on the selective enlargement of the hydrophobic component particles of the feed material through addition of small quantities of bridging oil (collector). These aggregates are collected by air bubbles in the flotation operation. The collector, typically kerosene, is emulsified with small amounts of oleic acid which may act as a foaming agent. However, the economic feasibility of these processes, including aggregatative flotation, depends on the dosage of bridging oil necessary, as well as the degree to which the oil is able to selectively bridge particles of the desired mineral, as opposed to that from which the desired mineral is to be separated. Turbulence caused by the rise of large air bubbles may result in poor selectivity.

As noted above, efforts have been made in the art to improve the efficiency of coal flotation by use of microbubbles. One process for producing these bubbles is electroflotation in which bubbles 0.02 to 0.1 millimeter in diameter are produced by electrolysis. Such fine bubbles are said to be capable of floating particles below 10 microns in size. While electroflotation is effective for producing microbubbles, it may prove too energy intensive for beneficiation of a relatively low cost resource such as coal.

Meyer et al. U.S. Pat. No. 4,308,133, describes a coal flotation process in which an polycyclic aromatic compound bearing at least one nuclear sulfonic acid or sulfonate moiety is used as a froth promoter to improve recovery of coal. Specifically, the froth promoter is a diphenyl ether which is sulfonated in one or both rings and which may also be alkyl substituted in one or both rings. The promoter is said to be used in a weight ratio of 0.0005 to 0.1 kilograms per metric ton of coal, the working examples illustrating a dosage range of between about 0.006 and 0.016 kilograms per metric ton. The frothing agent is a conventional frother such as polypropylene glycol, methylisobutylcarbinol, diisobutylcarbinol, mixtures of polypropylene glycol and diisobutylcarbinol, 2-ethyl-1-hexanol, etc.

Klimpel and Hansen, "Chemistry of Fine Coal Flotation" describe various flotation processes and reagents used in coal flotation. In the category of dispersants, i.e., compounds which prevent coating of larger coal particles with slimes of clay, etc., this article lists sodium silicates, lignin sulfonates, petroleum sulfonates and polyacrylates.

SUMMARY OF THE INVENTION

Among the several objects of the present invention, therefore, may be noted the provision of an improved flotation process for the cleaning and beneficiation of coal; the provision of such a process which is effective for separating pyrite from the coal; the provision of such a process which recovers carbonaceous matter and energy value in high yield; the provision of such a process which may be economically operated; the provision of such a process which utilizes modest unit volumes of frothing and other flotation processing reagents; the provision of such a process which can be implemented in conventional coal flotation facilities and using generally conventional coal flotation operating techniques; the provision of such a process which is effective for beneficiation of ultrafine coal; the provision of such a process which effects both high energy value recovery and effective pyrite separation from ultrafine coal; and the provision of reagent compositions effective for cleaning of coal and separation of pyrite therefrom.

Briefly, therefore, the present invention is directed to a process for cleaning particulate coal and separation therefrom of pyrite and ash. A particulate coal feed material is slurried in an aqueous liquid flotation composition to produce a pulp, the feed material comprising particles of carbonaceous matter, particles comprising pyrites and particles comprising ash. The aqueous liquid flotation composition contains an anionic surfactant selected from among alkanesulfonic acids, alkenesulfonic acids, alkynesulfonic acids, arenesulfonic acids, alkyl sulfuric acids, alkenyl sulfuric acids, alkynyl sulfuric acids, aryl sulfuric acids, and salts of said acids, the pulp containing at least about 0.3 pounds of said surfactant per ton of particulate feed material. The pulp is aerated to produce bubbles therein, whereby the particles of carbonaceous material contained in the pulp adhere preferentially to the surfaces of the bubbles and are carried by the bubbles to the upper surface of the liquid where a foam of the bubbles is formed. The solids contained within the foam are enriched in the carbonaceous matter, while the solids in a zone of the liquid phase below the foam are relatively enriched in particles comprising pyrite and particles comprising ash. The foam is separated from the liquid phase comprising the aforesaid zone, and the carbonaceous matter is recovered from the foam.

The invention is further directed to a process for cleaning particulate coal of the aforesaid type and separation of the pyrite and ash therefrom. A particulate coal feed material, having a particle size distribution such that at least 75% by weight of the particles thereof are smaller than 400 mesh, is slurried in an aqueous liquid flotation composition to produce a pulp. The aqueous liquid flotation composition contains an anionic surfactant of the type described above. The pulp is aerated, the foam is separated from the liquid phase, and the carbonaceous matter is recovered from the foam in the matter described above.

The invention is further directed to a process for cleaning particulate coal, and separation therefrom of pyrite and ash, in which a particulate coal feed material is slurried in an aqueous liquid flotation composition to produce a pulp. The feed material comprising particles of carbonaceous matter, particles comprises pyrite and particles comprising ash. The aqueous liquid flotation composition contains an anionic surfactant corresponding the formula:

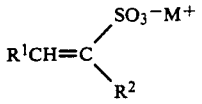

where each of our $R^1$ and $R^2$ is independently selected from among hydrogen and hydrocarbon substituents, and M is a cation selected from among hydrogen, metal, ammonium, and alkylated ammonium. As in the above described process, the pulp is aerated to produce bubbles therein, whereby the particles of carbonaceous material contained in the pulp adhere prefentially to the surfaces of the bubbles and are carried by the bubbles to the upper surface of the liquid where a foam of the bubbles is formed. The solids contained within the foam are enriched in the carbonaceous matter, while the solids in the liquid phase below the foam are relatively enriched in pyrite and ash. The foam is separated from the liquid phase comprising the aforesaid zone, and carbonaceous matter is recovered from the foam.

Further included in the invention is a composition of matter comprising a nonionic compound and an anionic surfactant. The nonionic compound is selected from among alcohols, terpinols, phenolics, glycols, polyglyeols, ethers and alkanolamides. The anionic surfactant is selected from among metal salts of a monoester of fatty alcohol and sulfuric acid, and a compound corresponding to the formula:

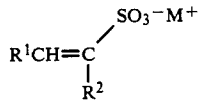

where each of $R^1$ and $R^2$ is independently selected from the group consisting of hydrogen and hydrocarbon substituents, and M is a cation selected from among hydrogen, metal, ammonium, and alkylated ammonium. The weight ratio of said anionic surfactant and said nonionic compound is between about 1:3 and 4:1.

Other objects and features will be in part apparent and in part pointed out hereinafter.

DESCRIPTION OF THE PREFERRED EMBODIMENTS

Figure 1:
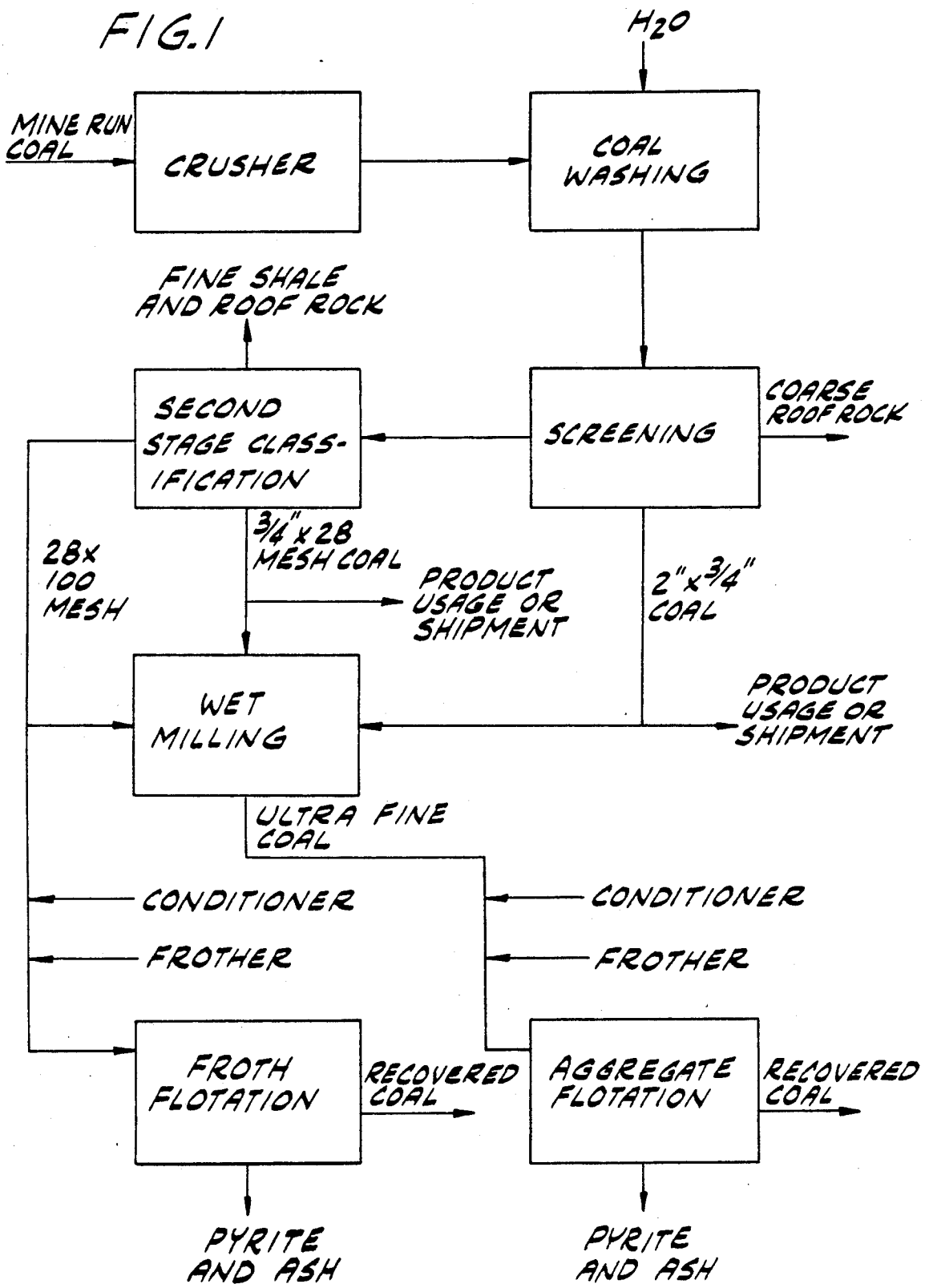
FIG. 1 is a flowsheet illustrating the process of the invention.

In accordance with the present invention, it has been discovered that the effectiveness of flotation for the cleaning and recovery of fine coal is substantially improved by the use of certain anionic surfactants in the flotation pulp. More particularly, it has been discovered that such anionic surfactants can be used in place of conventional nonionic frothing agents, and are substantially more effective frothers on a unit weight basis. By use of these anionic surfactants as frothing agents, high yields are realized, both in terms of weight recovery of carbonaceous matter and recovery of the energy value of the coal.

Where such anionic reagents are used in accordance with the process of the invention, advantageous results are also achieved with respect to separation of pyrite from the particulate coal feed material. Especially effective removal of pyrite is achieved when the coal is first reduced to an ultrafine particulate feed material. By reduction of the particle size to a level at which the pyrite particles are liberated from surrounding carbonaceous matter, and subsequent flotation using the appropriate anionic surfactants, highly efficient sulfur removal is achieved, without sacrifice in the yield of carbonaceous matter and recovery of the B.T.U. value of the coal.

It has further been found that the process of the invention can be implemented using essentially conventional coal flotation apparatus, so that existing coal flotation installations can be converted to the novel process without radical retrofitting or excessive downtime. Moreover, the investment in existing installations can be preserved, while realizing the enhanced product quality that is provided by flotation in the presence of aforesaid anionic surfactants. Thus, the process of the invention can be implemented in a generally conventional system such as that illustrated in FIG. 1 of the drawing There, run-of-mine coal is first crushed, washed, and then rough screened, producing a fraction of roof rock and shale, a coarse fraction of 2"×¾" coal, and a relatively fine fraction of minus ¾" coal. The latter fraction is subjected to a second stage of classification, normally conventional gravity separation but often supplemented by other fines classification steps such as cycloning, to produce an intermediate fraction of ¾"×28 mesh coal, a fraction of fine shale and roof rock, and a fraction of fine coal having a particle size in the range of 28 mesh and below, typically 28×100 mesh.

In accordance with one embodiment of the invention, the product of the second stage classification may be directly subjected to froth flotation. In this instance, the particulate coal feed material is nominally 28×100, but in common practice is actually about 20% by weight 28×65 mesh, and about 20–25% by weight 65×100 mesh, the balance being minus 100 mesh material. Of that balance, a somewhat disproportionate share is normally constituted of ash and pyrite. In most froth flotation operations, the particulate coal feed material comprises at least about 30% by weight of plus 100 mesh material, but this is not essential.

In an alternative and preferred embodiment of the invention, the fine coal from the second stage classification is subjected to further size reduction, advantageously by wet grinding or wet milling, to produce a fraction which is predominantly minus 200 mesh, preferably at least about 50% by weight minus 400 mesh, more preferably at least about 75% by weight minus 400 mesh. This process has been referred to in the art, and is sometimes referred to herein, as "aggregate flotation". As noted, reduction to ultrafine size effectively liberates the pyrite particles from the coal, thereby producing a particulate feed material which, when subjected to flotation by the process of the invention, provides a high yield of carbonaceous product from which a substantial portion of pyrite has been rejected. Thus, significant reduction in pyritic sulfur content is achieved at modest reagent dosage, without serious sacrifice in energy recovery.

Because the pyrite and ash are usually not distributed uniformly throughout the coal, and because the typical particle size of the pyrite causes it to be embedded in 28×100 mesh coal particles, there is some tendency for the pyrite to concentrate in the coal fines during size reduction processing. It is for this reason that effective pyrite removal from fines has been an important need in coal processing, even where the pyrite content of the coarser fractions has been relatively acceptable. However, an alternative embodiment of the present invention provides the option of reducing the pyrite content of the initial coarse fraction as well. As shown in FIG. 1, this alternative process subjects the coarse fractions to further size reduction to produce an ultrafine coal from which the pyrite is removed using the anionic surfactants which have been found effective for this purpose.

Anionic surfactants useful as frothing agents in the process of the invention include alkanesulfonic acids, alkenesulfonic acids, alkynesulfonic acids, arenesulfonic acids, alkyl sulfuric acids, alkenyl sulfuric acids, alkynyl sulfuric acids, aryl sulfuric acids, and salts of said acids. Thus, among the exemplary anionic surfactants useful in the process of the invention are toluenesulfonic acid, benzenesulfonic acid, xylenesulfonic acid, alkylbenzenes sulfonic acids such as dodecylbenzenesulfonic acid, sulfonated aliphatics such as octanesulfonic acid, decanesulfonic acid, dodecane sulfonic acid, 4-octene-1-sulfonic acid, 6-dodecene-1-sulfonic acid, and 3-hexyne-1-sulfonic acid, and salts of such acids. Particularly preferred surfactants include salts of a monoester of a fatty alcohol and sulfuric acid, especially alkali metal salts of lauryl sulfate such as sodium lauryl sulfate, and substituted and unsubstituted ethenesulfonic acids. The latter compounds typically correspond to the stuctural formula:

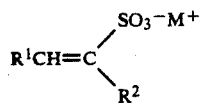

where $R^1$ and $R^2$ are independently selected from among hydrogen and hydrocarbon substituents, and M is selected from among hydrogen, metal, ammonium, and alkylated ammonium groups. Either $R^1$ or $R^2$ or both may be an aliphatic group such as methyl, ethyl, propyl, butyl, pentyl, hexyl, heptyl, octyl, decyl, dodecyl, ethenyl, propenyl, butenyl, octenyl, ethynyl, propynyl, cyclohexyl, cyclohexenyl or the like. $R^1$ and/or $R^2$ may also be an aryl group such as phenyl, toluyl, xylyl, naphthyl, etc. Where M+ is metal, it is preferably an alkali metal, such as sodium on potassium, or an alkaline earth such as magnesium, calcium or barium. Dialkylethenesulfonate type salt reagents may be produced by the reaction of a di-primary alkyl sulfone with a carbon tetrahalide in the presence of a strong base such as potassium hydroxide, as described in Meyers et al U.S. Pat. No. 3,876,689. This process produces a substituted ethenesulfonate salt in which the alkyl groups are in cis relationship to each other. Such structure, in which the lipophilic moieties are located on one side of the rigid molecule, and the hydrophilic sulfonic acid group is located on the other, is believed to have especially favorable surfactant properties and to be an especially desirable frothing agent.

Unexpectedly, it has been found that relatively low molecular weight cis-1,2-dialkylethenesulfonate salts provide especially superior performance when used as frothing agents for the flotation of coal. While each of $R^1$ and $R^2$ may contain 12 or more carbon atoms, it has been found preferable to use a species in which the total number of carbon atoms in the molecule is no greater than about 12, more preferably no greater than about 8. Species which have been demonstrated to provide good results include that in which both $R^1$ and $R^2$ are n-pentyl, and especially that where $R^1$ and $R^2$ are n-propyl.

Except for the novel use of the aforesaid anionic surfactant as a frothing agent, generally conventional practices may be followed in producing a pulp for feed to the flotation cell in the process of the invention. Conveniently, therefore, particulate coal feed material may be slurried in water and the frothing agent added to the resulting slurry to produce a pulp which is fed continuously to a flotation cell. The frothing agent may be added to the coal/water slurry just prior to flotation. Preferably, the frothing agent is injected into a pipeline carrying the slurry stream into the flotation cell, injection being made at point which allows at least 2 to 3 seconds residence time for mixing before the pulp is delivered to the cell. As the frothing agent is added, it dissolves or disperses in the aqueous phase to provide an aqueous liquid flotation composition, the suspension of particulate coal feed material in this composition comprising the pulp that is subjected to flotation.

For froth flotation, i.e., flotation of a particulate coal feed material that is roughly in the 28×100 mesh range, the pulp should contain between about 3% and about 15% by weight, preferably between about 6% and about 12% by weight of the particulate feed material. In a typical application of froth flotation, the feed material is substantially minus 28 mesh, but at least about 30% by weight is usually larger than 100 mesh. For aggregrate flotation, i.e., where the feed material has an average particle size of minus 200 mesh, preferably at least about 75% by weight minus 400 mesh, the pulp strength in terms of particulate coal feed material should be in the range of between about 2% and about 10% by weight, preferably between about 3% and about 8% by weight.

Where an ethenesulfonate type anionic surfactant is used as the principal frothing agent, it should be present in the pulp in a concentration of at least about 0.1 pounds per ton of particulate coal feed material. For other anionic surfactants, the minimum concentration should be about 0.3 pounds per ton of feed material. For aggregrate flotation, the minimum concentration of ethenesulfonate as the principal frothing agent is about 0.4 pounds per ton of feed, and the minimum concentration for other anionics is about 0.5 pounds per pound of feed, a loading which can produce a BTU recovery on the order of 50%. For higher BTU recoveries, the minimum loading of other anionic surfactant is preferably 0.6 or 0.7 pounds per ton. Typical ranges of proportions of anionic surfactant frothing agent for particular types of coal are set forth below in Table 1 for froth flotation and in Table 2 for aggregate flotation, the units in each instance being pounds anionic surfactant per ton. Because the carbonaceous matter of lower rank bituminous coal is less hydrophobic than that of higher rank bituminous coal, higher proportions of reagent are required for effective flotation.

TABLE 1

Surfactant Dosage - Froth Flotation (lbs./ton feed)

| Type of Coal | EtSO3- | Other Anionic |
|---|---|---|
| Medium volatile to high volatile A bituminous | 0.2–0.6 | 0.3–0.8 |
| High volatile B/C: | | |
| Illinois No. 5 | 0.5–1.0 | 0.7–2 0 |
| Illinois No. 6 | 0.5–1.0 | 0.7–2.0 |
| Illinois No. 2 | — | — |

TABLE 2

Surfactant Dosage - Aggregate Flotation (lbs./ton feed)

| Type of Coal | EtSO3- | Other Anionic |
|---|---|---|
| Medium volatile to high volatile A bituminous | 0.5–0.75 | 0.9–1.8 |
| High volatile B/C: | | |
| Illinois No. 5 | 0.8–1.2 | 0.9–1.8 |
| Illinois No. 6 | 1.3–2.0 | 1 8–3.6 |
| Illinois No. 2 | 2–3 | 3–8 |

In addition to the frothing agent, the pulp may contain auxiliary reagents such as conditioners, collectors and promoters. Conditioners serve to render the surface of the carbonaceous matter more hydrophobic, thereby enhancing the selectivity of adherence of the carbonaceous matter to the bubbles preferentially to adherence thereto of the pyrite and ash. Collectors serve to aggregate the particulate feed material so as to improve the probability of the particle/bubble collisions necessary for attachment of the particles to the bubbles. In many instances, the materials which serve as conditioners double as collectors. Preferably, the conditioner/collector comprises a hydrocarbon oil such as fuel oil or kerosene. Promoters are considered to function in a manner similar to collectors.

As further illustrated in FIG. 1, the conditioner, collector or other auxiliary reagent is preferably injected upstream of the point of injection of the frothing agent, typically at a point sufficiently removed to allow 3–4 seconds residence time in the pipeline for conditioning of the carbonaceous surfaces before injection of the frothing agent. Generally, a conditioner or collector is incorporated at a loading of between about 1 and about 4 pounds per pound of frothing agent, but this may be varied in accordance with principles known to those skilled in the art. In the froth flotation embodiment of the invention, i.e., that which operates with a particulate coal feed material roughly in the range of $28\times100$ mesh, it is preferred that a conditioner/collector, such as kerosene, be used. Somewhat surprisingly, however, it has been found that where the particulate coal feed material is ultrafine, it is not usually necessary to incorporate a conditioner or collector, despite the appellation applied to this embodiment, i.e., "aggregate" flotation.

Although the flotation process is often operated at the "natural pH", i.e., whatever the pH adjusts to after the coal has been slurried and frothing agent, collector, etc., have been added, it is preferred that the pH be in the range of about 5 to about 9 during the flotation step. If the natural pH should be outside that range, it is desirable to add a common inorganic base or acid to control the pH in the desired range before introduction of the pulp into the flotation cell.

Figure 2:
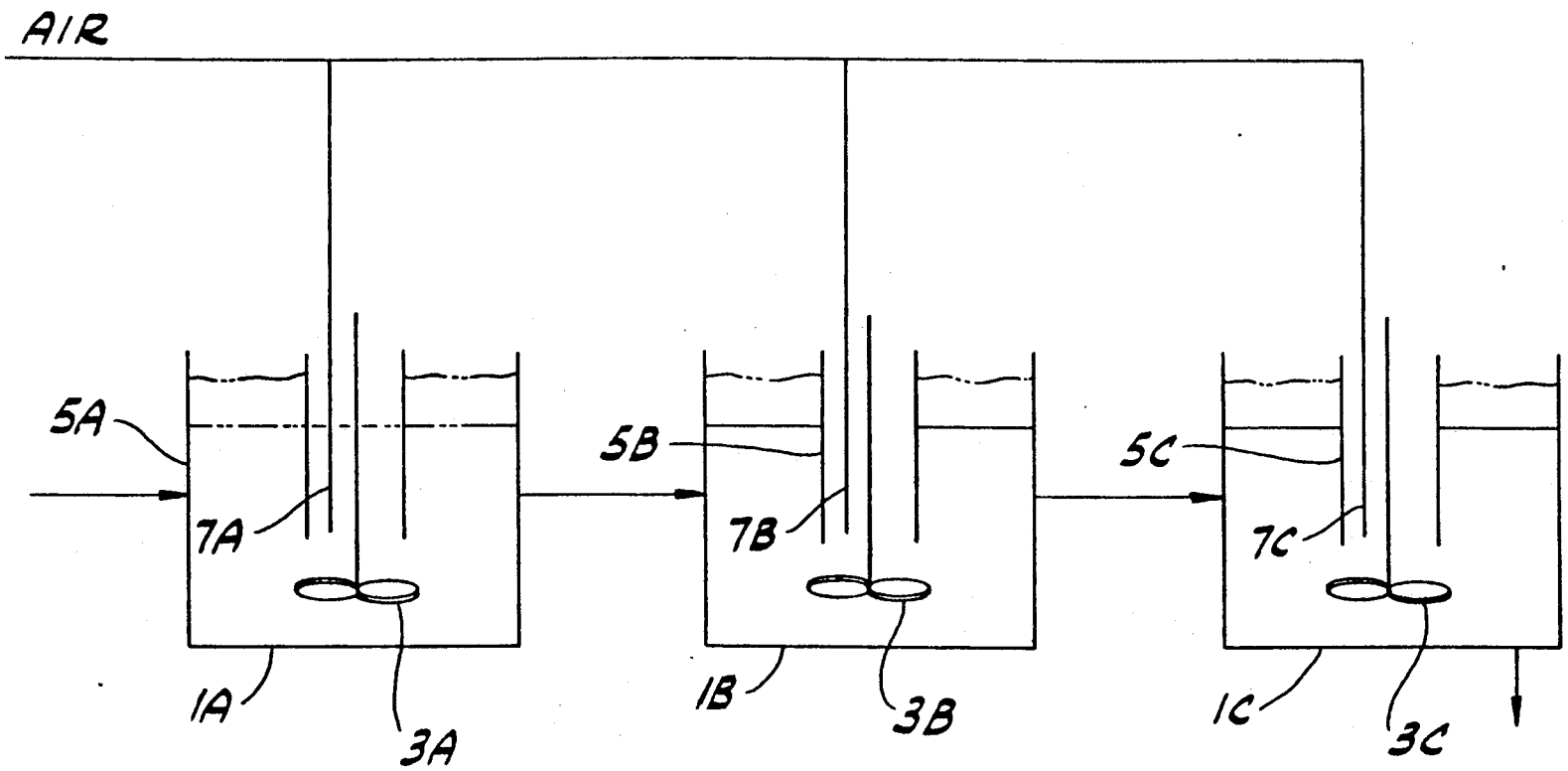
FIG. 2 is a schematic diagram of the flotation cell system used in the process of the invention.

As illustrated in FIG. 2, the pulp is passed continuously through a cell into which air is continuously sparged. Advantageously, the pulp is passed through a plurality of cells 1A, 1B and 1C which are oriented in series. The pulp in each cell is stirred by an agitator 3, and air is sparged into each cell through a pipe sparger 5 that is located within a draft tube 7 positioned above the agitator. Sparging is carried out at an air to pulp ratio of about 2 or 3 to one for froth flotation and between about 1.0 and about 1.5 to one for aggregate flotation. Thus, the practice of aggregate flotation in accordance with the method of the invention provides a relatively quiescent liquid phase zone below the foam, which facilitates sedimentation of the particles containing pyrite and separation thereof from the carbonaceous matter that is floated. Where the pulp contains at least about 0.10–0.15 pounds of anionic surfactant per ton of particulate coal feed material, the bubbles generated by aeration generally have an average diameter of less than about 1000 microns, preferentially 100 to 500 microns. This facilitates attachment of carbonaceous particles to the bubbles, minimizing the tendency of small carbonaceous particles to flow around the bubbles. The froth produced in each cell, which contains solids that are relatively enriched in carbonaceous matter, is removed from the upper liquid surface in each cell. The foam is collapsed and the carbonaceous solid product recovered therefrom by any convenient means, such as filtration. Solids contained in a zone of the liquid phase below the foam become relatively enriched in particles which comprise pyrite and ash. The liquid phase passes in series from cell to cell, the liquid phase discharged from the last cell containing the tailings which may then be separated by filtration from the liquid and discarded. It has been found that a liquid phase residence time of only one to three minutes in the entire series of flotation cells provides adequate time for separation of high rank bituminous coal. Lower rank bituminous coals, such as those mined in Illinois, typically require 4 to 12 minutes residence time, but this may vary further depending on cell size. Operation is at ambient temperature, which may typically range from 40° to 100° F.

Among the particularly advantageous applications of the process of the invention is in the flotation of, and separation of pyrite from, relatively low rank coals. Although it has generally been found difficult to recover low rank coals by flotation, the process of the invention has been proven effective for cleaning of low rank coal and separation of the carbonaceous content of the coal from the ash. It has further been discovered that certain of the ethenesulfonate type surfactants are especially effective for the flotation of low rank coals and separation of pyrite therefrom. More particularly, it has been found that, where ethenesulfonate salt surfactants are used as frothing agents, high volatile bituminous coals, i.e., those having a fixed carbon content (dry, mineral-free matter basis) of less than 69% by weight, a volatile matter content (same basis) of greater than 31% by weight, and a dry calorific value of less than 14,000 B.T.U. per pound, and a typical pyritic sulfur content of 0.3-% to 4.0% by weight, can be floated to produce a carbonaceous product of low pyritic sulfur content at a high yield in both weight recovery and recovery of energy value. It has been found that lower molecular weight 1,2-dialkylethenesulfonate salts, in particular those in which the alkyl substituents are in cis orientation to each other, which are generally preferred for use as frothing agents, are especially advantageous when used for flotation of such relatively low rank bituminous coals. Uniquely good separations have been obtained by use of $C_{12}$ and particularly $C_8$ ethenesulfonate salts on high volatile C rank bituminous coal.

Further in accordance with the invention, it has been discovered that substantially improved recovery of carbonaceous matter and rejection of pyrite is achieved where the aqueous flotation composition contains a combination of one of the aforesaid anionic surfactants and a conventional nonionic frothing agent. Nonionic frothing agents which may be used in this embodiment of the invention include such polar organic compounds as alcohols, terpinols, phenolics, glycols, polyglycols, ethers and alkanolamides. Other nonionic frothing agents known to those skilled in the art, for example, those listed in Meyer U.S. Pat. No. 4,308,133 are generally suitable. However, particularly preferred nonionic frothing agents are: alcohols such as methyl isobutyl carbinol, 2-ethylhexanol, and pine oil; cresols; and 1,1,3,-triethoxybutane.

It has been found that a combination of the anionic surfactant and an alcohol provides a synergistic improvement in the effectiveness of coal flotation. While the anionic surfactant alone is effective as a frothing agent at a concentration much lower than that required for the alcohol alone, the combination of surfactant and alcohol provides markedly improved separations when used at dosages essentially equivalent to those referred to above for anionic surfactant alone. Where such combination is used, the proportion of anionic surfactant ranges between about 25% and about 80% by weight of the sum of the two, i.e., the weight ratio of anionic surfactant to nonionic frother is between about 1:3 and 4:1. Thus, for example, for froth flotation of an Eastern high rank bitumiuous coal, the sum of anionic surfactant and alcohol or other nonionic frother concentrations in the pulp should be between about 0.2 and about 0.6 lbs. per ton of particulate coal feed material, with each of the two reagents being present in a proportion of between about 0.05 to about 0.5 lbs per ton, but in any event representing at least 25% by weight of the aforesaid sum. For aggregate flotation of high rank bituminous coal, the sum of proportions of the two reagents should be between about 0.5 and about 0.75 lbs. per ton of feed material, with each representing 25% to 80% of that sum. Similarly, the sums of proportions of the two reagents should approximate the proportions listed above for anionic surfactant alone in the flotation of Illinois Nos. 2, 5, and 6 coal.

While we do not wish to be held to any particular theory, it is believed that both the surfactant and nonionic frothing agent contribute to generation of the froth. However, where the concentration of anionic surfactant alone is in the range of 0.1 lbs. per ton of coal or higher, this surfactant tends to control the bubble size in a range below about 1000 microns, and normally between about 100 and about 500 microns, thereby maximizing the probability of contact between carbonaceous particle and bubble and enhancing the efficiency of the separation of the carbonaceous matter from the pyrite. Additionally, the anionic surfactant tends to serve also as a conditioner which increases the hydrophobicity of the carbonaceous particles, thereby further contributing to the efficiency of the separation. Especially favorable results have been observed where an alcohol type nonionic frother is used in combination with an ethenesulfonate type anionic surfactant. The efficiency of separation in the flotation of relatively low rank coals has been found to be at a maximum where the aqueous flotation composition contains a combination of an alcohol, such as methylisobutylcarbinol, 2-ethyl-1-hexanol or pine oil, and a cis-1,2-dialkylethenesulfonate salt containing not more than about 12 carbon atoms, preferably not more than about 8 carbon atoms.

In carrying out the process using a combination of anionic surfactant and nonionic frothing agent, the two may be premixed and injected together at a point which provides a residence time, for example, of 2–3 seconds in the feed pipeline upstream of the first flotation cell. Alternatively, the nonionic frothing agent may be injected at this point and the anionic surfactant injected further upstream, advantageously at the point where a conditioner would otherwise be injected, i.e., approximately 3–4 seconds before the injection of the frother.

The various embodiments of the process of this invention provide a coal processor with a number of attractive options for the recovery of fine coal and the separation therefrom of pyritic sulfur. More particularly, the process of the invention opens up the feasibility of much broader uses of high sulfur bituminous coals, which currently have only a limited market because of the restrictions on point source emissions and the national and international concerns about acid rain. Moreover, the process of the invention is especially attractive from a commercial standpoint because its operation departs only very modestly from conventional coal flotation systems. Thus, existing installations can be converted to the process with a minimum of capital expense, retrofitting, and process downtime.

The mixture which contains both an ethenesulfonate type anionic surfactant and a nonionic frothing agent is a novel composition of matter. In addition to its utility in the flotation of ultrafine coal, this composition can be used in such applications as air drilling in enhanced oil recovery, additives for coal water slurry, or in the flotation of noncarbonaceous minerals.

When used as the aqueous flotation composition in coal flotation, the composition of the invention contains between about 0.00005% and about 0.05% by weight of each of the anionic surfactant and nonionic compound, the sum of the proportions of the two reagents being between about 0.00015% and about 0.05% by weight. When premixed as a concentrate to be injected into a fine coal slurry to produce a flotation pulp, the composition may comprise an essentially anhydrous mixture of surfactant and nonionic compound. Preferably, however, it is an aqueous mixture which typically contains between about 10% and about 30% by weight of the surfactant and between about 5% and about 50% nonionic compound, the sum of proportions being between about 25% and about 80% by weight. In all instances, the anionic surfactant constitutes between about 25% and about 80% by weight of the sum of said proportions. The concentrate may conveniently be prepared by either directly mixing anhydrous surfactant with anhydrous nonionic compound, or by mixing a concentrated aqueous solution of surfactant, e.g., a 25% by weight solution, with anhydrous nonionic compound.

The following examples illustrate the invention.

EXAMPLE 1

A run-of-mine Springfield SE coal (a high volatile A/B) which was representative of Illinois No. 5 seam, was subjected to size reduction yielding a product of 100% passing 6 mesh. Desliming and further separation by gravity tabling yielded a feed stock which was further reduced by wet-stirred ball milling to produce a sample of which 80% passed 400 mesh. This ultrafine product was then subjected to standard flotation tests using a series of aqueous flotation compositions respectively containing synthesized alkenesulfonic acid salts, as well as several commercially produced alkenenesulfonic acid salts, ethoxylated alkanesulfonate salts, linear alpha olefin sulfonate salts, and frothing alcohols, as frothing reagents.

In carrying out these tests, the ultrafine coal was mixed with water to produce a slurry containing 3.5 to 4.5% by weight solids. A predetermined known volume of this slurry was placed in a 4 liter Denver D-2 subaeration cell that was equipped with an agitator. The impeller speed was set at 1075 r.p.m. and the slurry agitated for two minutes to thoroughly distribute the solids. After the initial period of agitation, a predetermined quantity of frothing reagent was added and mixed with the slurry for two minutes to produce a flotation pulp. Air was then induced into the cell at a rate of 8 standard cubic feet per minute. A coal-laden froth was produced and collected by means of paddle scraping the froth by hand from the top of the cell into collection receivers. Collection continued for eight minutes. The solids and liquids from the froth concentrates and the tailings were separated by filtration, dried, and weighed, and then analyzed for moisture, ash, total sulfur, specific forms of sulfur including pyritic and sulfatic, and calorific value expressed in BTUs per pound. Weight and percent BTU recovery of carbonaceous matter, as well as ash and pyritic rejection values, were then determined.

Results for different doses of various reagents are set forth in Table 3. These results showed a distinct advantage with regard to both yield of carbonaceous matter and BTU recovery for the flotation runs in which the flotation agent comprised a cis-1,2-dialkylethenesulfonate salt containing a total of 12 carbon atoms. Commercially available frothing agents required significantly higher dosages to produce equivalent BTU recoveries. Additionally, the ash and pyrite grade for the products were improved as compared to feed material when cis-1,2-dialkylethenesulfonate salt surfactant was used.

TABLE 3

Dosage, Recovery, and Grade for Various Reagents in Flotation of Ultrafine-coal for the Springfield-SE (ILL No. 5) Sample.

| Reagent | Dosage # A/tds | % Wt Rec | % Btu Rec | % Ash Feed | % Ash Product | % PS Feed | % PS Product | % Ash Rej | % Py Rej |
|---|---|---|---|---|---|---|---|---|---|
| $K^+$(13 E)-6-dodecene | 0.8 | 81.5 | 85.2 | 9.6 | 5.5 | 1.18 | 0.92 | 53.3 | 36.1 |
| 6-sulfonate | 1.0 | 88.1 | 92.2 | 9.5 | 5.7 | 1.08 | 0.83 | 47.3 | 32.4 |
| $K^+$(E)-4-octene | 1.0 | 75.1 | 80.3 | 10.9 | 5.3 | 1.04 | 0.67 | 63.2 | 51.2 |
| 4-sulfonate | 1.2 | 80.3 | 85.0 | 10.2 | 5.6 | 1.1 | 0.70 | 55.6 | 94.7 |
| $CH_3(C_3H_6)CH(C_2H_5)CH_2OH$ | 1.2 | 64.0 | 69.6 | 11.5 | 4.2 | 1.14 | 0.56 | 77.3 | 68.5 |
| (2-ethylhexanol) | 1.4 | 68.9 | 74.3 | 11.2 | 4.6 | 1.02 | 0.57 | 71.6 | 62.2 |
| | 1.6 | 90.1 | 96.8 | 11.1 | 5.1 | 1.05 | 0.65 | 58.7 | 43.9 |
| $CH_3(CH_3)_{11}OSO_3Na$ | 1.4 | 74.5 | 79.5 | 11.2 | 5.5 | 1.08 | 0.67 | 63.4 | 53.8 |
| | 1.6 | 79.5 | 85.1 | 11.6 | 6.0 | 1.23 | 0.81 | 58.8 | 47.6 |
| | 1.8 | 85.9 | 91.2 | 11.2 | 6.0 | 1.12 | 0.77 | 54.0 | 40.9 |
| $CH_3CH(CH_3)CH_2CH(OH)CH_3$ | 2.1 | 66.8 | 72.5 | 12.4 | 3.8 | 1.28 | 0.58 | 79.5 | 69.7 |
| (MIBC) | 2.5 | 87.4 | 94.7 | 11.4 | 4.9 | 1.14 | 0.66 | 62.4 | 49.1 |
| $R - CH = CH - (CH_2)_nSO_3Na$ | 2.5 | 64.7 | 69.4 | 11.5 | 5.3 | 1.18 | 0.73 | 70.2 | 70.8 |
| $K^+$(E)-3-penta- | 3.2 | 85.4 | 88.5 | 9.8 | 6.7 | 0.98 | 0.79 | 42.0 | 31.1 |
| decene 3 & 4 sulfonate | 3.5 | 90.4 | 93.8 | 9.7 | 6.5 | 0.99 | 0.80 | 37.1 | 24.4 |
| $K^+$(E)-8-hexadecene | 2.5 | 62.2 | 66.8 | 12.1 | 5.9 | 1.11 | 0.70 | 69.8 | 60.8 |
| 8-sulfonate | 3.3 | 80.7 | 84.2 | 9.7 | 6.2 | 1.01 | 0.82 | 48.1 | 34.6 |
| $CH_3(CH_2)_{11}(OC_2H_2)_3$ | 3.3 | 76.8 | 82.2 | 11.4 | 5.8 | 1.17 | 0.77 | 58.9 | 48.3 |
| $OSO_3Na$ | | | | | | | | | |
| $C_mH_{nt1}O(C_2H_4O)C_2H_4SO_3Na$ | 2.6 | 32.6 | 35.7 | 12.1 | 4.5 | 1.13 | 0.54 | 87.8 | 84.7 |
| MW = 420 | 5.0 | 83.4 | 88.4 | 11.6 | 6.8 | 1.16 | 0.85 | 51.1 | 38.8 |
| $C_mH_{nt1}O(C_2H_4O)C_2H_4SO_3Na$ | 4.7 | 61.9 | 66.5 | 11.3 | 5.4 | 1.12 | 0.73 | 70.4 | 59.7 |
| MW = 600 | | | | | | | | | |
| $C_mH_{nt1}O(C_2H_4O)C_2H_4SO_3Na$ | 5.0 | 55.5 | 60.2 | 12.2 | 5.4 | 1.13 | 0.66 | 75.0 | 67.6 |
| MW = 690 | | | | | | | | | |
| $C_mH_{mt1}O(C_2H_4O)C_2H_4SO_3Na$ | 5.0 | 30.0 | 32.6 | 11.1 | 4.1 | 1.15 | 0.51 | 88.9 | 87.9 |
| MW = 950 | | | | | | | | | |

EXAMPLE 2

A run of mine Colchester-W coal (high volatile C) representative of the Illinois No. 2 seam, was subjected to size reduction yielding a product 100% passing 6 mesh. The minus 6 mesh run-of-mine coal was further reduced by wet-stirred ball milling to produce a sample of which 80% passed 400 mesh. This ultrafine product was then subjected to standard flotation tests using a series of synthesized alkene sulfonates as well as several commercially produced sulfates, surfactants and alcohols. The flotation tests were carried out in accordance with the method described in Example 1, using the Denver test apparatus described therein.

Results of the test runs of this example are set forth in Table 4. These results show a distinct advantage with regard to both weight yield of carbonaceous matter and BTU recovery where the frothing agent is a cis-1,2-dialkylethesulfonate salt surfactant having the total carbon content of 8. Commercially available reagents required significantly higher dosages to provide equivalent BTU recovery. Additionally, the ash and pyrite grade for the product recovered by the use of cis-1,2-dialkylethenselufonate salt surfactants showed improvement by comparison with the feed sample.

TABLE 4

Dosage, Recovery and Grade for Various Reagents in Flotation of Ultrafine-Coal for the Colchester-W (ILL. No. 2) Sample.

| Reagent | Dosage # A/tds | % Wt Rec | % Btu Rec | % Ash Feed | % Ash Product | % PS Feed | % PS Product | % Ash Rej | % Py Rej |
|---|---|---|---|---|---|---|---|---|---|
| $K^+$(E)-4-octene | 2.4 | 78.6 | 84.0 | 11.6 | 6.1 | 4.81 | 2.78 | 58.9 | 54.6 |
| 4-sulfonate | 3.1 | 86.7 | 92.5 | 10.5 | 6.3 | 4.83 | 3.01 | 52.3 | 45.8 |
| $K^+$(E)-6-dodecene- | 2.8 | 64.8 | 69.5 | 10.6 | 5.2 | 3.34 | 1.48 | 68.2 | 71.3 |
| 6-sulfonate | 4.1 | 86.6 | 91.0 | 10.5 | 5.8 | 3.26 | 1.90 | 52.6 | 50.1 |
| | 5.5 | 92.9 | 96.7 | 10.5 | 7.1 | 3.22 | 2.16 | 37.4 | 37.6 |
| $CH_3(CH_2)_{11}OSO_3Na$ | 6.4 | 19.2 | 20.8 | 10.7 | 4.4 | 3.30 | 1.06 | 92.1 | 93.9 |
| | 7.4 | 74.5 | 89.8 | 11.2 | 6.5 | 3.01 | 1.84 | 50.7 | 48.2 |
| | 7.7 | 85.8 | 90.5 | 10.7 | 6.7 | 3.34 | 2.06 | 46.1 | 47.0 |
| | 8.0 | 87.7 | 92.6 | 10.2 | 6.0 | 3.23 | 1.98 | 48.4 | 46.0 |
| $CH_3(C_3H_6)CH(C_2H_5)CH_2OH$ | 7.5 | 69.3 | 75.9 | 10.5 | 3.5 | 3.32 | 1.02 | 76.9 | 78.7 |
| (2-ethylhexanol) | 8.5 | 87.1 | 94.4 | 10.5 | 4.5 | 3.32 | 1.40 | 62.6 | 63.4 |
| $CH_3CH(CH_3)CH_2CH(OH)CH_3$ | 6.4 | 58.4 | 62.7 | 10.7 | 5.1 | 3.47 | 1.52 | 72.1 | 74.4 |
| (MIBC) | 10.8 | 68.9 | 76.2 | 10.6 | 3.8 | 3.79 | 0.98 | 75.3 | 82.1 |
| | 12.0 | 70.7 | 77.2 | 11.1 | 4.1 | 3.08 | 0.98 | 74.2 | 77.4 |
| | 13.7 | 90.8 | 94.1 | 10.7 | 7.9 | 3.42 | 2.53 | 32.6 | 32.8 |
| $K_+$ (E)-3-pentadecene- | 8.8 | 63.8 | 70.9 | 11.1 | 5.5 | 3.36 | 1.73 | 64.5 | 66.1 |
| 3 & 4 sulfonate | 8.9 | 81.2 | 86.1 | 11.2 | 6.7 | 2.93 | 1.57 | 51.9 | 56.5 |
| | 13.0 | 87.5 | 91.8 | 10.7 | 6.9 | 3.50 | 2.18 | 43.6 | 45.6 |
| $K_+$ (E)-8-hexadecene- | 10.7 | 82.8 | 86.1 | 11.2 | 8.2 | 2.99 | 2.06 | 39.3 | 43.1 |

TABLE 4-continued

| Reagent | Dosage # A/tds | % Wt Rec | % Btu Rec | % Ash Feed | % Ash Product | % PS Feed | % PS Product | % Ash Rej | % Py Rej |
|---|---|---|---|---|---|---|---|---|---|
| Dosage, Recovery and Grade for Various Reagents in Flotation of Ultrafine-Coal for the Colchester-W (ILL. No. 2) Sample. | | | | | | | | | |
| 8-sulfonate | 14.1 | 82.1 | 87.9 | 11.0 | 9.4 | 3.26 | 2.79 | 26.8 | 26.5 |

Other commercial reagents were not tested on the No. 2 coal due to excessive dosages required.
A/Tds—lbs active reagent/ton dry solids.

EXAMPLE 3

A sample of Springfield-SE coal (high volatile A/B), prepared as described in Example 1, was subjected to standard flotation tests using mixtures of anionic surfactants and 2-ethylhexanol. The flotation tests were carried out in the manner described in example 1.

The anionic surfactant and 2-ethylhexanol were incorporated in the flotation pulp on an equal weight basis at a dosage of 1.2 pounds total reagent per ton of dry particulate coal feed material, i.e., 0.6 pounds of each reagent per ton of feed material.

Results of the tests of this example are set forth in Table 5. This data shows the reduction in required reagent dosage and the enhanced BTU recovery provided by a mixture of alcohol frother and ethensulfonate surfactant. A synergistic result was achieved inasmuch as the combination of reagents provided a result superior to that achievable with either reagent by itself. Additionally, the ash and pyrite grade for the products recovered showed improvement by comparison with the feed sample.

Figure 3:
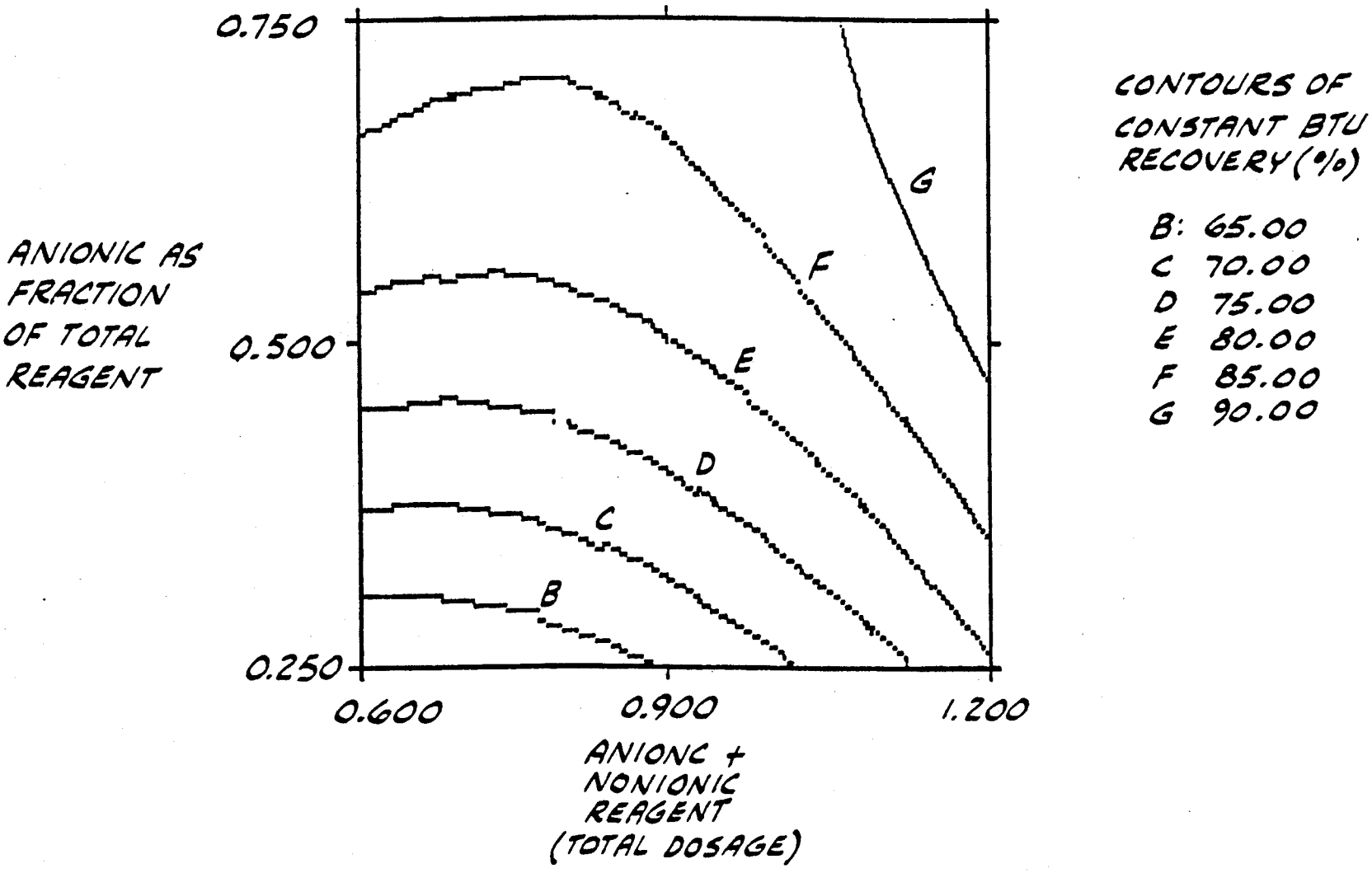
FIG. 3 is a response surface diagram, based on data from Example 3 herein, showing BTU recovery as a function of total reagent and the fraction of reagent represented by an ethenesulfonate surfactant.
Figure 4:
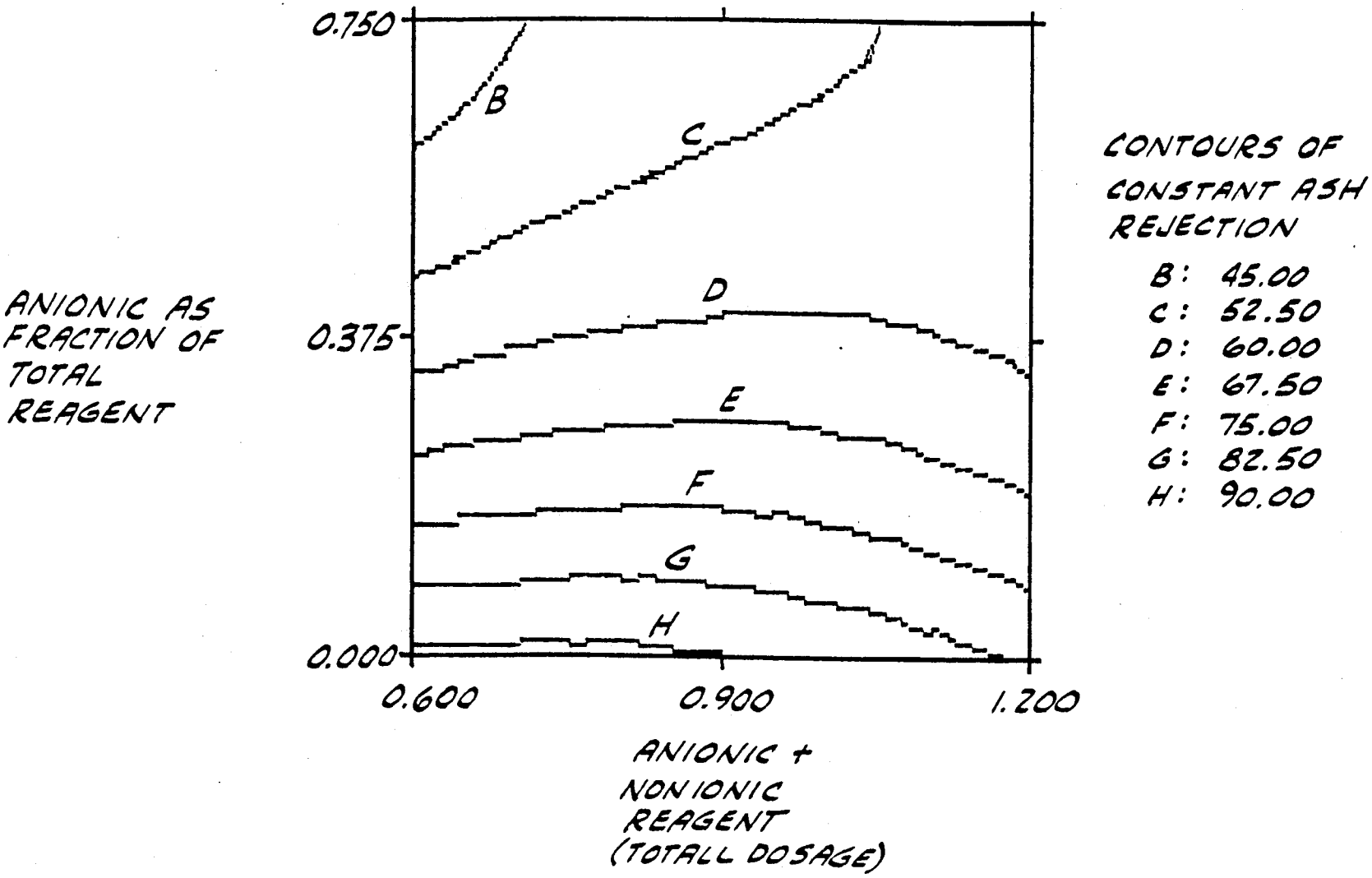
FIG. 4 is a response surface diagram, also based on the data of Example 3, showing ash rejection as a function of total reagent and the fraction of reagent represented by an ethenesulfonate surfactant.
Figure 5:
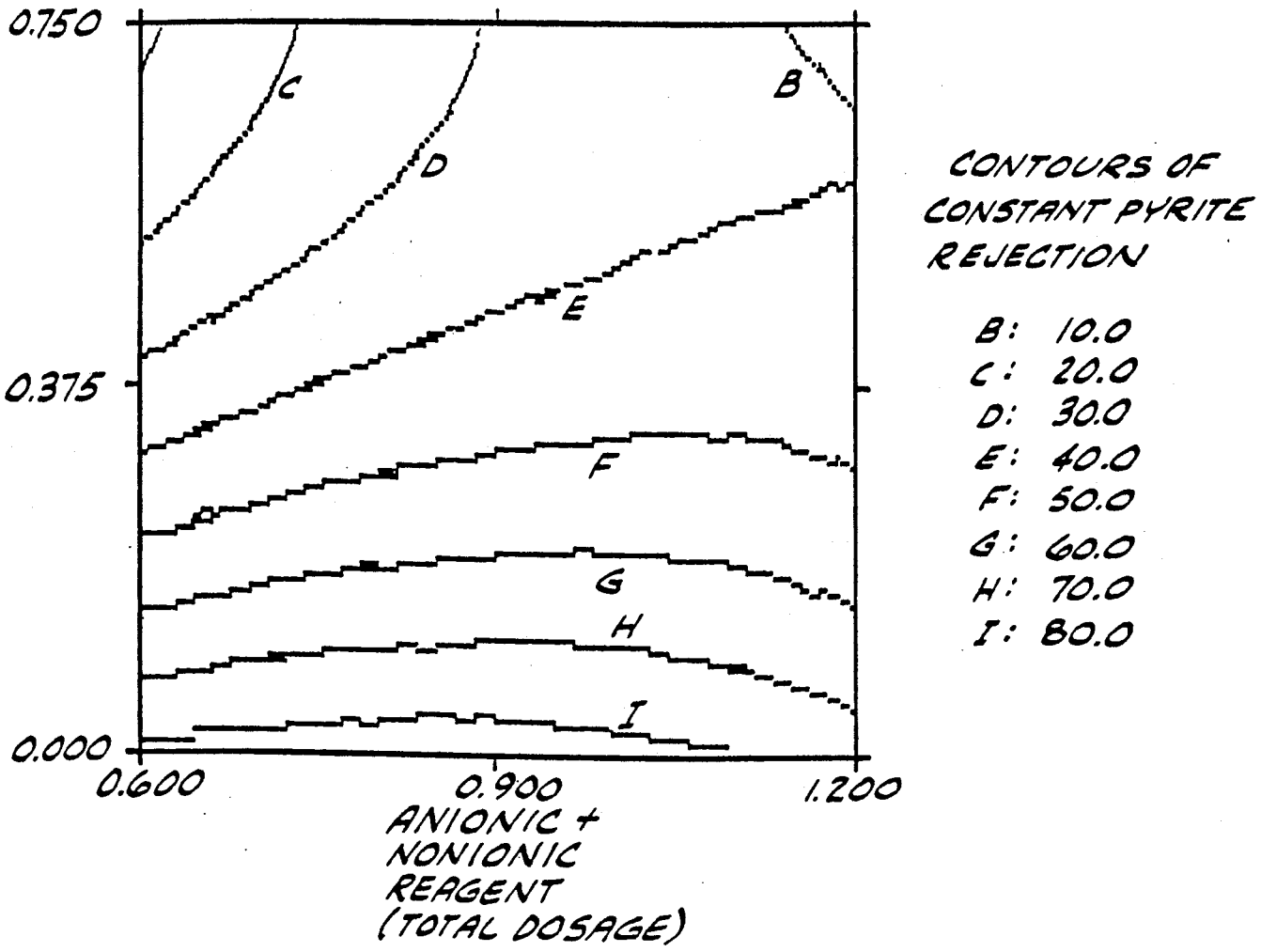
FIG. 5 is a response surface diagram, also based on the data of Example 3, showing pyrite rejection as a function of total reagent and the fraction of reagent represented by an ethenesulfonate surfactant.

Shown in FIG. 3 is a response surface diagram representing the BTU recovery vs. total reagent dosage and fraction of reagent constituted by ethenesulfonate surfactant, as generated by computer analysis of the data of this example. FIG. 4 shows the response surface diagram for ash rejection, and FIG. 5 shows the response surface diagram for pyrite rejection, also in each case plotted as a function of total reagent dosage and fraction of reagent constituted by ethenesulfonate surfactant.

EXAMPLE 4

An sample of run of mine Upper Freeport seam coal (high volatile A) was subjected to the standard flotation test conducted in the method described in Example 1 except that the aeration rate was approximately 15 standard cubic ft/hr and the impeller speed was 1500 rpm. This sample was generally 28×0 mesh size, the actual particle distribution being such that 80% by weight of the sample was −65 mesh. Flotation reagents used in the test of this example included pure $K^+$(E)-6-dodecene-6 sufonate as well as mixture of this surfactant and methyl isobutyl carbinol (MIBC).

The results of the tests of this example, as set forth in Table 6, indicate that the pure $K^+$(E)-6-dodecene-6-sulfonate by itself provided a higher BTU recovery at lower dosage compared to MIBC. However, a further synergistic improvement was obtained from the combination of anionic surfactant and MIBC. Statistical analysis of this data, including computer generated surface diagrams, indicates, for example, that a total dosage of 0.4 pounds MIBC per ton of dry feed material provides a BTU recovery of approximately 79%. However, at a dosage which consisted of 0.2 pounds MIBC plus 0.2 pounds of anionic surfactant, the BTU recovery was increased to approximately 95%.

Figure 6:
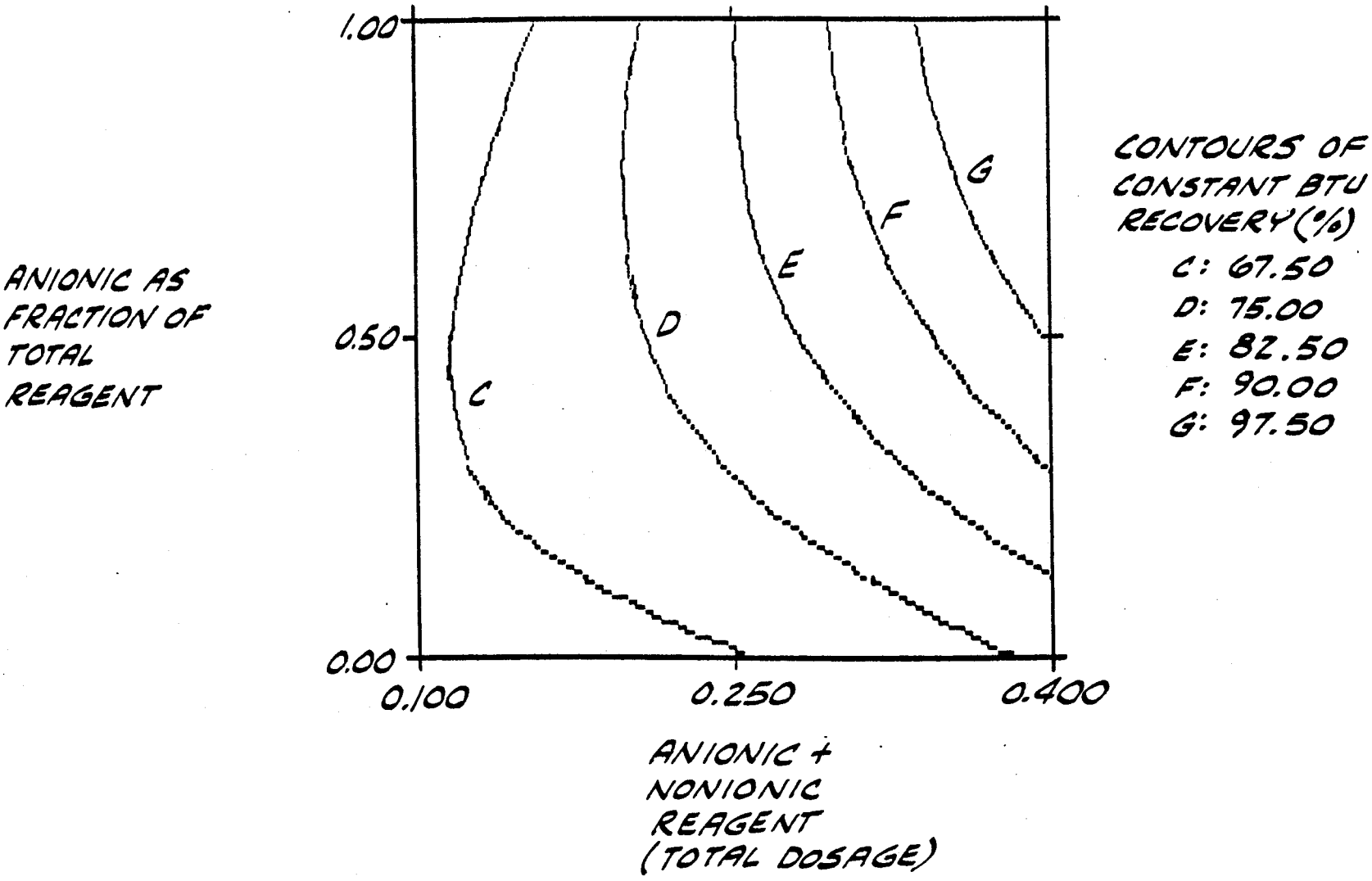
FIG. 6 is a diagram similar to FIG. 3 but based on the data of Example 4.
Figure 7:
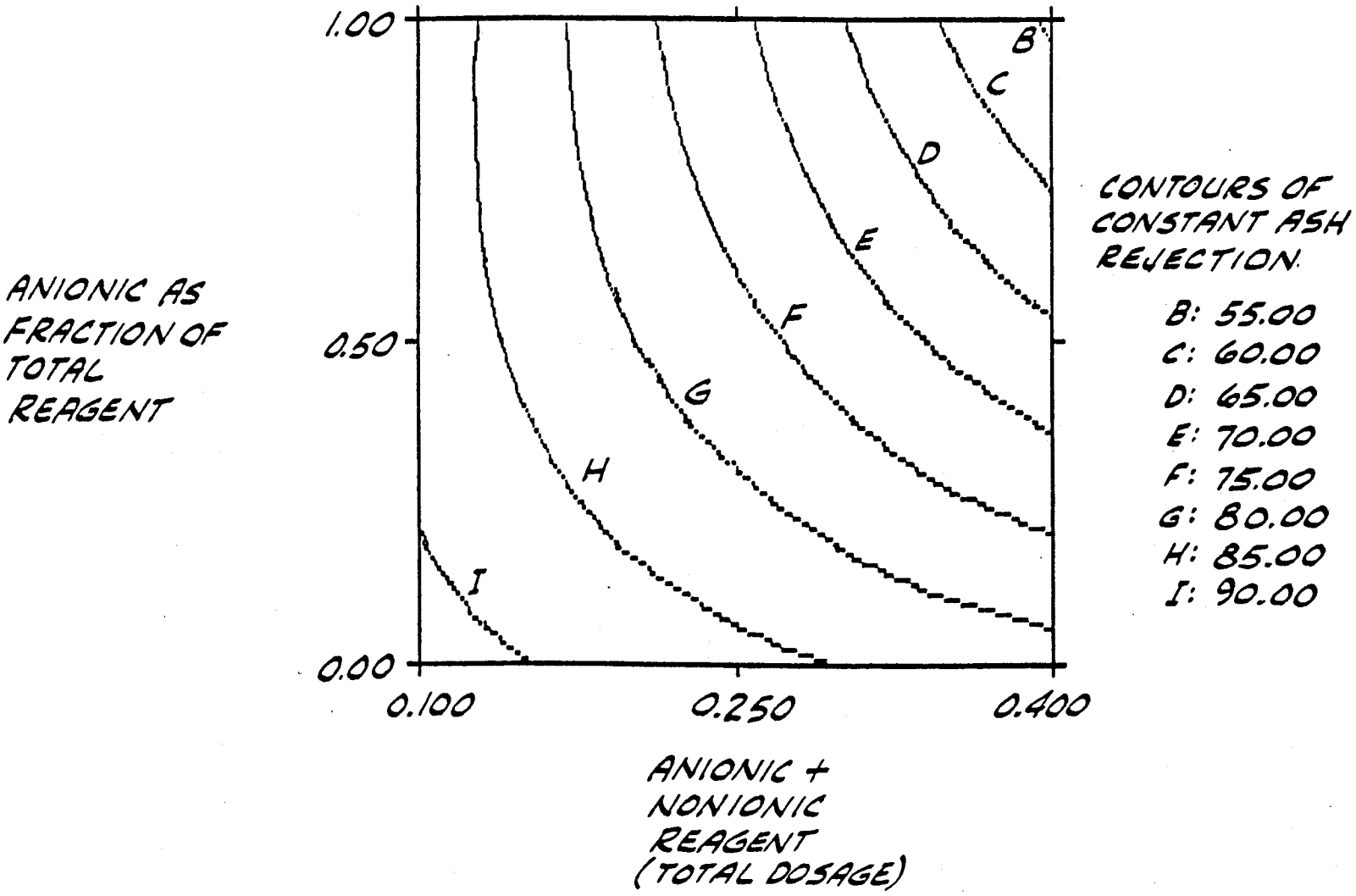
FIG. 7 is a diagram similar to FIG. 4 but based on the data of Example 4.
Figure 8:
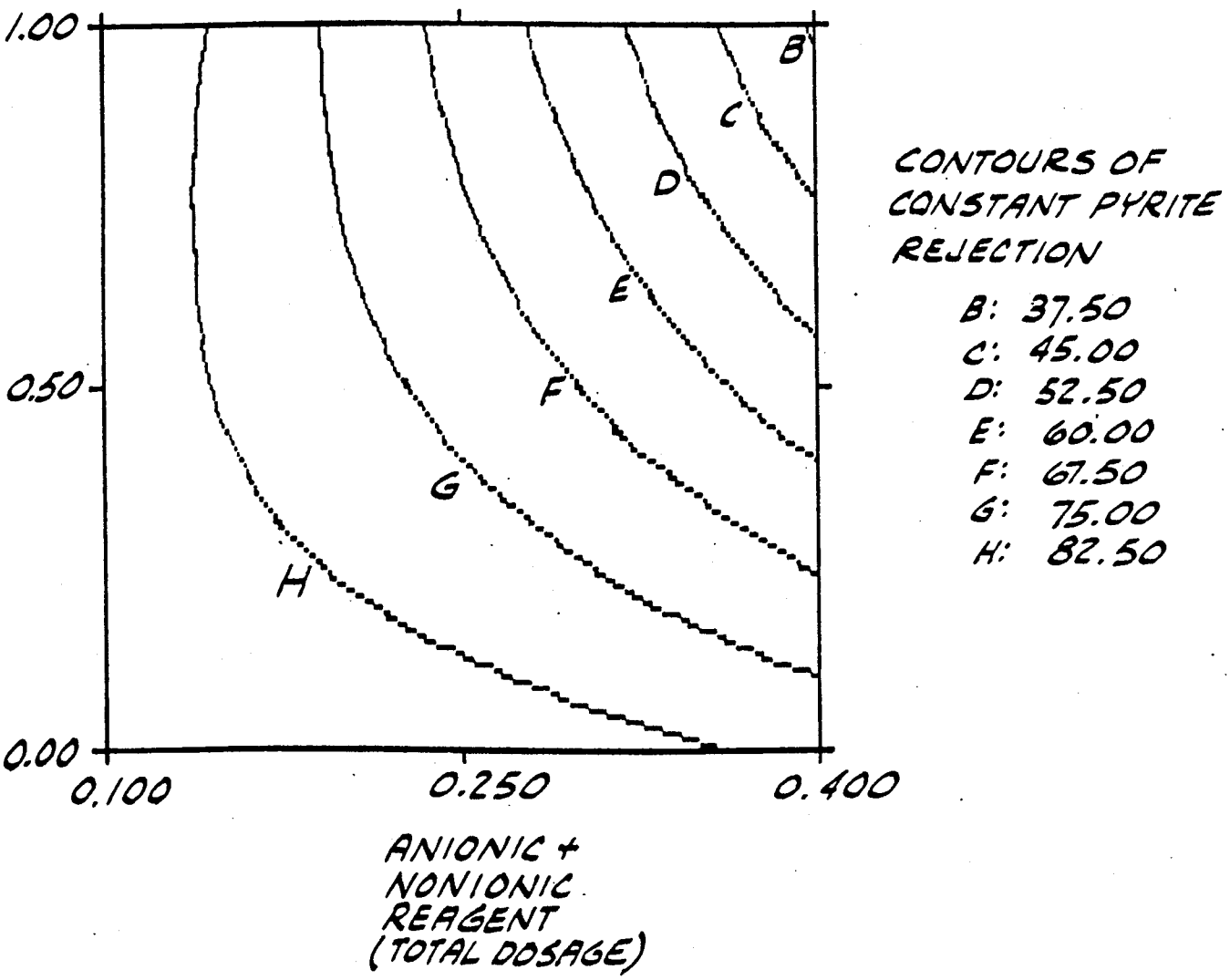
FIG. 8 is a diagram similar to FIG. 5 but based on the data of Example 4.

FIGS. 6–8 show the response surface diagram for BTU recovery, ash rejection and pyrite rejection, respectively, as developed from the data obtained from the tests of this example in which a combination of ethenesulfonate and MIBC reagents was used.

TABLE 5

| Reagent | Dosage # A/tds | % Wt Rec | % Btu Rec | % Ash Feed | % Ash Product | % PS Feed | % PS Product | % Ash Rej | % Py Rej |
|---|---|---|---|---|---|---|---|---|---|
| Dosage, Recovery, and Grade for Mixtures in Flotation of Ultrafine-coal for the Springfield-SE (ILL No. 5) Sample | | | | | | | | | |
| K-6-D-6-S | 0.8 | 81.5 | 85.2 | 9.6 | 5.5 | 1.18 | 0.92 | 53.3 | 36.1 |
| | 1.0 | 88.1 | 92.2 | 9.5 | 5.7 | 1.08 | 0.83 | 47.3 | 32.4 |
| 2-EH | 1.2 | 64.0 | 69.0 | 11.5 | 4.2 | 1.14 | 0.53 | 77.3 | 68.5 |
| | 1.4 | 68.9 | 74.3 | 11.2 | 4.6 | 1.02 | 0.56 | 71.6 | 62.2 |
| | 1.6 | 90.1 | 96.8 | 11.1 | 5.1 | 1.05 | 0.65 | 58.7 | 43.9 |
| K-6-D-6-S + 2-EH | 0.06 1.11 | 55.3 | 59.4 | 9.9 | 3.6 | 1.04 | 0.54 | 80.0 | 72.5 |
| K-6-D-6-S + 2-EH | 0.3 0.9 | 73.1 | 78.1 | 10.0 | 4.3 | 1.03 | 0.64 | 68.4 | 55.8 |
| K-6-D-6-S + | 0.45 0.75 | 84.1 | 88.7 | 10.2 | 5.7 | 1.02 | 0.71 | 53.3 | 41.6 |
| K-6-D-6-S + | 0.6 0.6 | 85.5 | 91.7 | 10.1 | 5.2 | 1.14 | 0.76 | 55.5 | 42.1 |
| K-8-H-8-S + 2-EH | 0.65 0.65 | 73.9 | 78.4 | 10.5 | 5.4 | 1.00 | 0.65 | 61.7 | 51.6 |
| K-3-P-3 & 4-S + 2-EH | 0.59 | 70.8 | 74.5 | 9.8 | 5.2 | 0.89 | 0.64 | 62.2 | 49.4 |

A/tds—lbs active reagent/ton dry solids; K-6-D-6-S = $K^+$(E)-6-dodecene-sulfonate; K-8-H-8-S = $K^+$(E)-8-hexadecene-8-sulfonate; K-3-P-3 & 4-S = $K^+$(E)-3-pentadecene-3 & 4-sulfonate 2EH = ethylhexanol

TABLE 6

| Reagent | Dosage # A/tds | Recovery, % wt | Recovery, % Btu | Ash % Feed | Ash % Product | Pyritic Sulfur, % Feed | Pyritic Sulfur, % Product | Rejection, % Ash | Rejection, % Pyritic S |
|---|---|---|---|---|---|---|---|---|---|
| Results for Upper Freeport (ROM28X0) Using MIBC and MIBC/Surfactants Mixtures | | | | | | | | | |
| MIBC | 0.20 | 51.1 | 65.2 | 23.9 | 5.5 | 0.99 | 0.23 | 88.2 | 88.1 |

TABLE 6-continued

| Results for Upper Freeport (ROM28X0) Using MIBC and MIBC/Surfactants Mixtures | | | | | | | | | |
|---|---|---|---|---|---|---|---|---|---|
| | Dosage | Recovery, % | | Ash % | | Pyritic Sulfur, % | | Rejection, % | |
| Reagent | # A/tds | wt | Btu | Feed | Product | Feed | Product | Ash | Pyritic S |
| | 0.40 | 60.9 | 76.1 | 24.0 | 7.1 | 0.97 | 0.31 | 82.0 | 80.6 |
| MIBC | 0.10 | 53.1 | 66.8 | 23.5 | 5.7 | 0.92 | 0.21 | 87.1 | 87.9 |
| K-6-D-6-S | 0.10 | | | | | | | | |
| MIBC | 0.10 | 75.4 | 89.6 | 22.9 | 9.9 | 0.88 | 0.47 | 67.4 | 59.4 |
| K-6-D-6-S | 0.20 | | | | | | | | |
| MIBC | 0.20 | 63.9 | 78.8 | 23.9 | 7.9 | 0.94 | 0.35 | 78.8 | 76.2 |
| K-6-D-6-S | 0.10 | | | | | | | | |
| MIBC | 0.20 | 61.1 | 76.4 | 23.8 | 6.9 | 0.96 | 0.31 | 82.2 | 80.2 |
| K-6-D-6-S | 0.10 | | | | | | | | |
| K-6-D-6-S | 0.19 | 62.4 | 78.7 | 25.2 | 7.9 | 1.00 | 0.37 | 80.5 | 76.9 |
| | 0.29 | 75.1 | 89.5 | 23.2 | 10.2 | 0.94 | 0.52 | 67.0 | 58.3 |
| DOW-150 | 0.30 | 71.8 | 87.2 | 23.6 | 9.2 | 0.96 | 0.49 | 72.1 | 63.5 |
| NALCO 8834 | 0.30 | 57.2 | 70.9 | 23.5 | 7.3 | 0.95 | 0.32 | 82.2 | 80.7 |

MIBC = methylisobutylcarbinol
K-6-D-6-S = $K^+$(E)-6-dodecene-6-sulfonate

EXAMPLE 5

TABLE 7

| Froth Flotation Results for −100 Mesh Feed to Froth Flotation Cells (Pittsburgh No. 8 Seam Coal) | | | | | | | | | | | | | | | | |
|---|---|---|---|---|---|---|---|---|---|---|---|---|---|---|---|---|
| | Collection | Elementary, % | | | | | | Cummulative, % | | | | | | Recovery % | Rejection % | |
| | Time, sec | WT | Ash | PS | OS | TS | BTU | WT | Ash | PS | PS | TS | Btu | Btu | Ash | Pyrite |
| Conc 1 | 0–60 | 49.5 | 9.7 | 1.26 | 0.64 | 1.90 | 13590 | 49.5 | 9.7 | 1.26 | 0.64 | 1.90 | 13590 | 70.4 | 85.7 | 66.4 |
| Conc 2 | 60–120 | 11.6 | 15.5 | 1.37 | 0.69 | 2.09 | 12620 | 61.1 | 10. | 1.28 | 0.65 | 1.93 | 13400 | 85.7 | 80.4 | 57.8 |
| Conc 3 | 120–240 | 5.3 | 23.7 | 1.34 | 0.54 | 1.88 | 11250 | 66.4 | 11.8 | 1.29 | 0.64 | 1.93 | 13230 | 92.0 | 77.6 | 54.0 |
| Tails | — | 33.6 | 76.5 | 2.98 | 0.05 | 3.03 | 2260 | 100 | 33.6 | 1.86 | 0.44 | 2.30 | 9540 | — | — | — |
| | Collection | Elementary, % | | | | | | Cummulative, % | | | | | | Recovery % | Rejection % | |
| | Time, sec | WT | Ash | PS | OS | TS | Btu | WT | Ash | PS | OS | TS | Btu | Btu | Ash | Pyrite |
| Conc 1 | 0–60 | 46.2 | 5.8 | 0.52 | 0.66 | 1.19 | 14160 | 46.2 | 5.8 | 0.52 | 0.66 | 1.19 | 14160 | 68.2 | 91.9 | 84.0 |
| Conc 2 | 60–120 | 12.6 | 9.5 | 0.91 | 0.52 | 1.43 | 13640 | 58.8 | 6.6 | 0.60 | 0.63 | 1.24 | 14050 | 86.1 | 88.3 | 76.4 |
| Conc 3 | 120–240 | 7.8 | 20.6 | 2.11 | 0.45 | 2.57 | 11790 | 66.6 | 8.2 | 0.78 | 0.61 | 1.40 | 13785 | 95.7 | 83.5 | 65.5 |
| Tails | — | 33.4 | 82.7 | 2.94 | 0.09 | 3.03 | 1240 | 100 | 133.1 | 1.50 | 0.44 | 1.94 | 9590 | — | — | — |

$K^+$(E)-6-dodecene-6-sulfonate; 0.53 lb/ton, 4 1 Denver cell, 1500 rpm, maximum natural aeration rate
2 Ethylhexanol; 1.1 lb/ton, 4 1 Denver Cell, 1500 rpm, maximum natural aeration rate
PS = pyritic sulfur; OS = organic sulfur; TS = total sulfur Samples of the fine coal (Pittsburgh No. 8 seam) obtained from a commerically operating coal preparation plant, were subjected to flotation tests using the method described in Example 4. This feed material was about 70% minus 100 mesh.

Results of the tests of this example are set forth in Table 7. These data provide a comparison of the related effectiveness of $K^+$(E)-6-dodecene-6-sulfonate vs. 2-ethylhexanol on a dosage basis. To obtain about the same degree of BTU recovery, the required dosage of 2-ethyl-1-hexanol was twice that of $K^+$(E)-6-dodecene-6-sulfonate.

Figure 9:
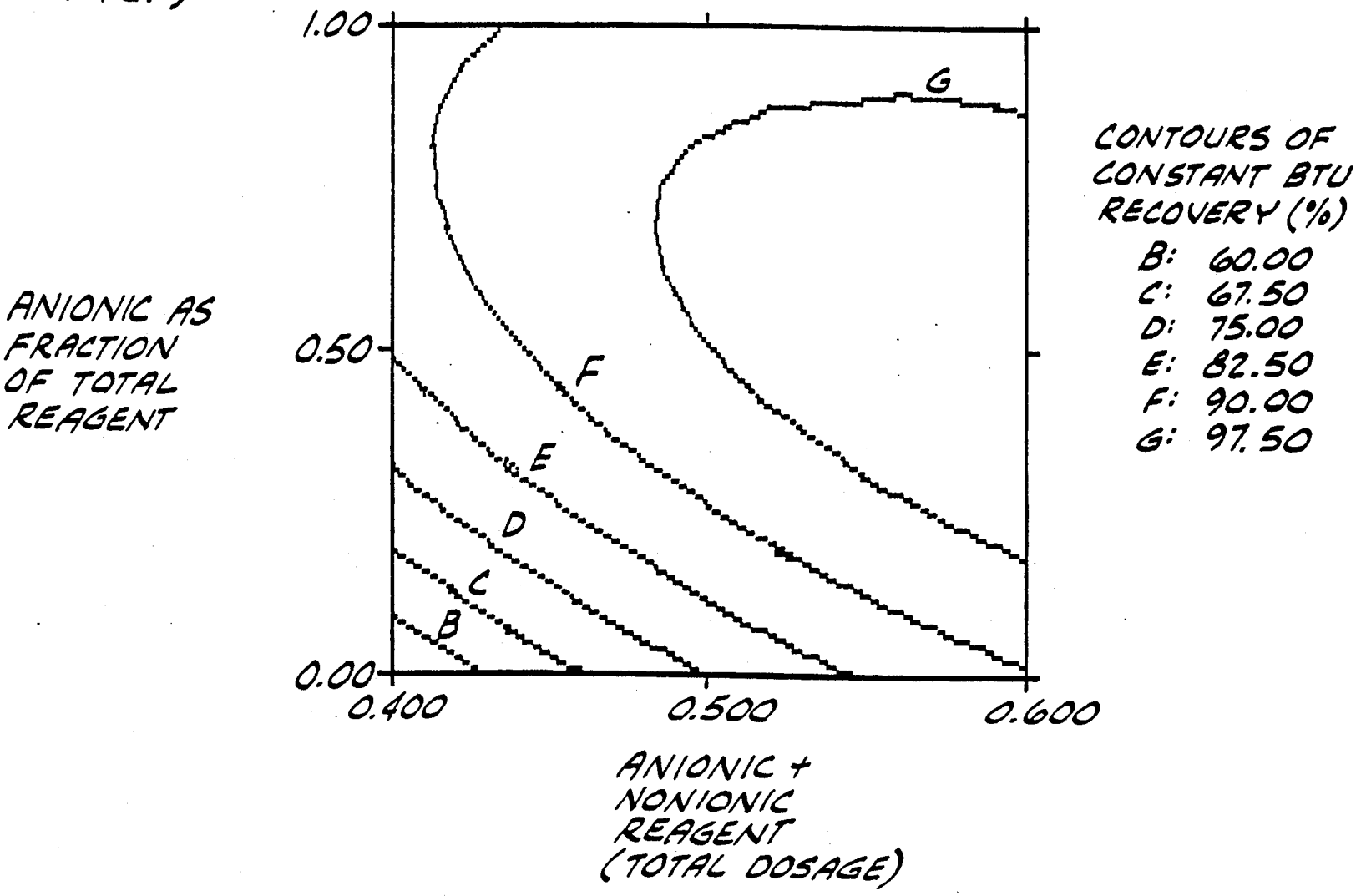
FIG. 9 is a diagram similar to FIG. 3 but based on the data of Example 5.
Figure 10:
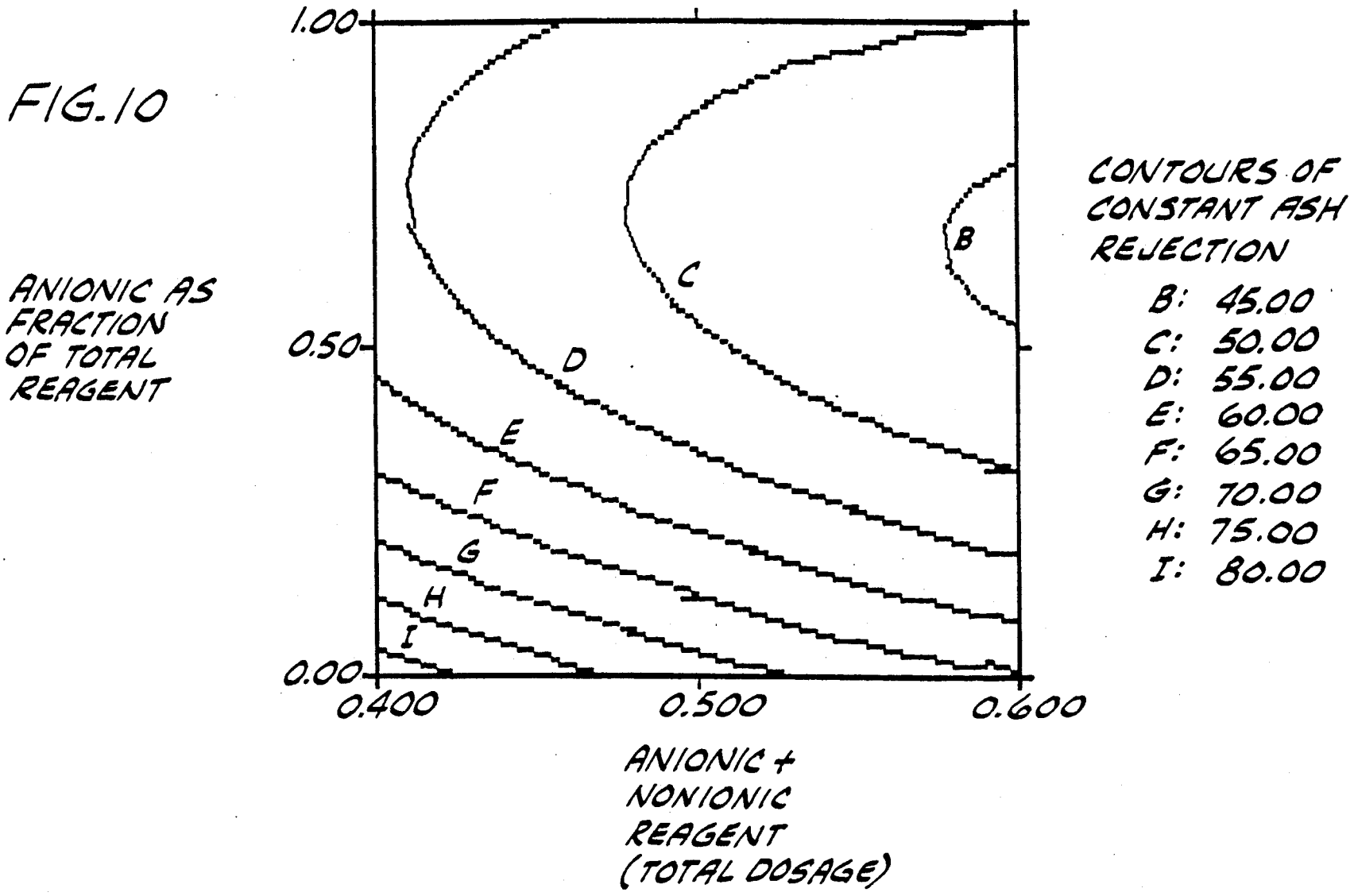
FIG. 10 is a diagram similar to FIG. 4 but based on the data of Example 5.
Figure 11:
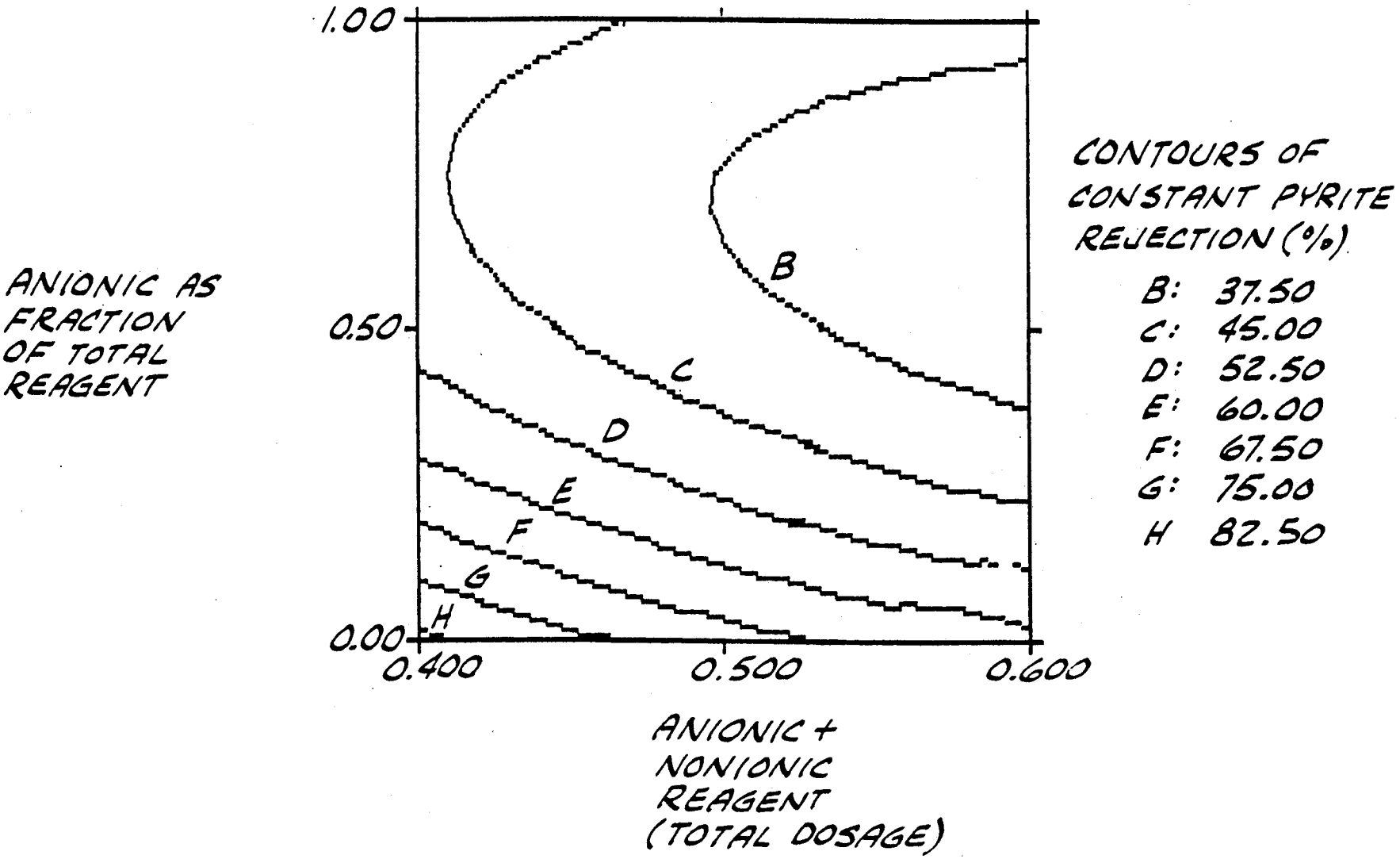
FIG. 11 is a diagram similar to FIG. 5 but based on the data of Example 5.

FIGS. 9–11 show the response surface diagrams for BTU recovery, ash rejection, and pyrite rejection, respectively, for the runs of this example in which a combination of ethenesulfonate and 2-ethylhexanol was used.

EXAMPLE 6

A sample was obtained of run of mine Pittsburgh No. 8 seam coal (high volatile A) having a nominal 28×0 mesh size, the actual particle size distribution being 80% minus 65 mesh. This sample was subjected to standard flotation tests in the manner described in Example 4. Both pure $K^+$(E)-6-dodecene-6-sulfonate and a mixture of this surfactant with MIBC were examined for effectiveness as flotation reagents.

Results of the tests of this example are set forth in Table 8. These results again indicate that the pure anionic sulfonate surfactant provided higher BTU recovery at lower dosages as compared to MIBC. Moreover, the results of this example provide further evidence of the synergistic effect in BTU recovery obtained by use of the mixture of anionic surfactant and MIBC.

TABLE 8

| Results for Pittsburgh No. 8 Coal (ROM, 28X0) Using MIBC, $K^+$(E)-6-Dodecene-6-Sulfonate and Mixtures THEREOF | | | | | | | | | |
|---|---|---|---|---|---|---|---|---|---|
| | Dosage | Recovery, % | | Ash % | | Pyritic Sulfur, % | | Rejection, % | |
| Reagent | # A/tds | Wt | Btu | Feed | Product | Feed | Product | Ash | Pyritic S |
| MIBC | 0.40 | 46.8 | 53.0 | 15.6 | 5.7 | 2.21 | 0.77 | 82.9 | 83.7 |
| MIBC | 0.59 | 77.7 | 86.7 | 15.5 | 6.7 | 2.19 | 0.99 | 66.5 | 64.9 |
| MIBC | 0.80 | 86.6 | 93.6 | 15.4 | 7.5 | 2.21 | 1.18 | 58.8 | 88.7 |
| K-6-D-6-S | 0.14 | 28.1 | 31.4 | 15.8 | 6.7 | 2.27 | 0.91 | 88.2 | 54.2 |
| K-6-D-6-S | 0.31 | 67.5 | 74.5 | 15.7 | 7.8 | 2.19 | 1.35 | 66.4 | 58.4 |
| K-6-D-6-S | 0.60 | 84.5 | 91.5 | 15.2 | 9.0 | 2.14 | 1.50 | 50.1 | 40.8 |
| MIBC + | 0.20 | 76.0 | 82.8 | 15.2 | 8.2 | 2.15 | 1.40 | 58.8 | 50.4 |

TABLE 8-continued

Results for Pittsburgh No. 8 Coal (ROM, 28X0) Using MIBC, K+(E)-6-Dodecene-6-Sulfonate and Mixtures THEREOF

| | Dosage | Recovery, % | | Ash % | | Pyritic Sulfur, % | | Rejection, % | |
|---|---|---|---|---|---|---|---|---|---|
| Reagent | # A/tds | Wt | Btu | Feed | Product | Feed | Product | Ash | Pyritic S |
| K-6-D-6-S | 0.20 | | | | | | | | |

K-6-D-6-S = K+(E)-6-dodecene-6-sulfonate

EXAMPLE 7

A run of mine Herrin coal (high volatile C), representative of the Illinois No. 6 seam, was subjected to size reduction to yield a product of 100% passing 6 mesh. The minus 6 mesh run of mine coal was further reduced in size by wet-stirred ball milling to produce a sample of which 80% passed 400 mesh. This product was then subjected to standard flotation tests which were conducted in the manner described in Example 1. Flotation reagents used in these tests included pure alkenesulfonates, alcohols, mixtures of alkenesulfonates with alcohols, mixtures of different alcohols, mixture of 2-ethylhexanol and kerosene, and mixtures of other sulfonate and sulfate surfactants with 2-ethylhexanol.

Results of the tests of this example are set forth in Table 9. These results show the beneficial effect of K+(E)-4-octene-4-sulfonate alone as compared to conventional alcohol frothers such as MIBC, 2-ethylhexanol or pine oil. Moreover, mixtures of the octene sulfonate anionic surfactant with 2-ethylhexanol exhibited improvements in that a lower total dosage, and lower fractions of each component, were required to produce BTU recovery equivalent to that obtained with any particular frothing agent alone. The degree of ash and pyritic sulfur rejection shows near equivalent results at approximately 89.5% BTU recovery, respectively realized with pure MIBC frothing agent at 8.4 pounds per ton of dry particulate feed matter and with a combined anionic surfactant/alcohol reagent at 1.0 pound of K+(E)-4-octene-4-sulfonate plus 2.0 pounds of 2-ethylhexanol per ton. Statistically designed dosage experiments using combinations of 2-ethyl-1-hexanol and kerosene produced surface response diagrams which were used for comparison to the results obtained from the mixture of K+(E)-4-octene-4-sulfonate and 2-ethylhexanol. For example, at 1.0 pounds K+(E)-4-octene-4-sulfonate and 2.0 pounds 2-ethylhexanol per ton, the BTU recovery was 89.3%. At equivalent dosages of 1.0 pounds 2-ethylhexanol per ton and 2.0 pounds kerosene per ton, the BTU recovery was 72%. Similarly, at 2.0 pounds 2-ethylhexanol per ton and 1.0 pound kerosene per ton, the BTU recovery was approximately 65%.

The combination of K+(E)-6-dodecene-6-sulfonate and 2-ethylhexanol also indicated a beneficial synergistic effect. However, the higher molecular weight alkenesulfonates and the sodium lauryl sulfate showed less favorable results in terms of BTU recovery when compared at near equivalent dosages to the K+(E)-4-octene-4-sulfonate.

Figure 12:
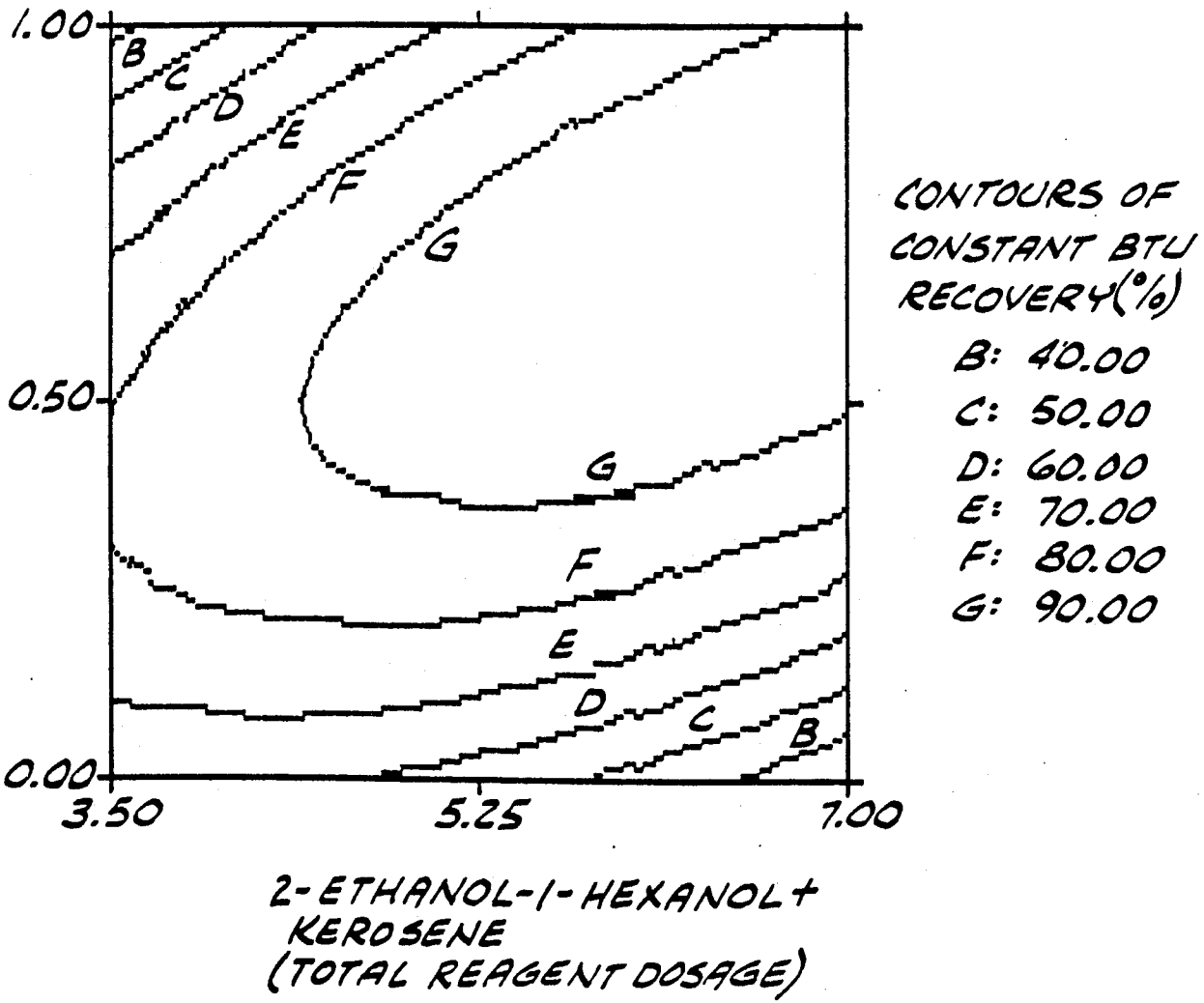
FIG. 12 is a response surface diagram, based on data from Example 7 herein in which flotation was carried out using a reagent mixture consisting of 2-ethyl-1-hexanol and kerosene, showing BTU recovery as a function of total reagent and the fraction of reagent represented by 2-ethyl-1-hexanol.
Figure 13:
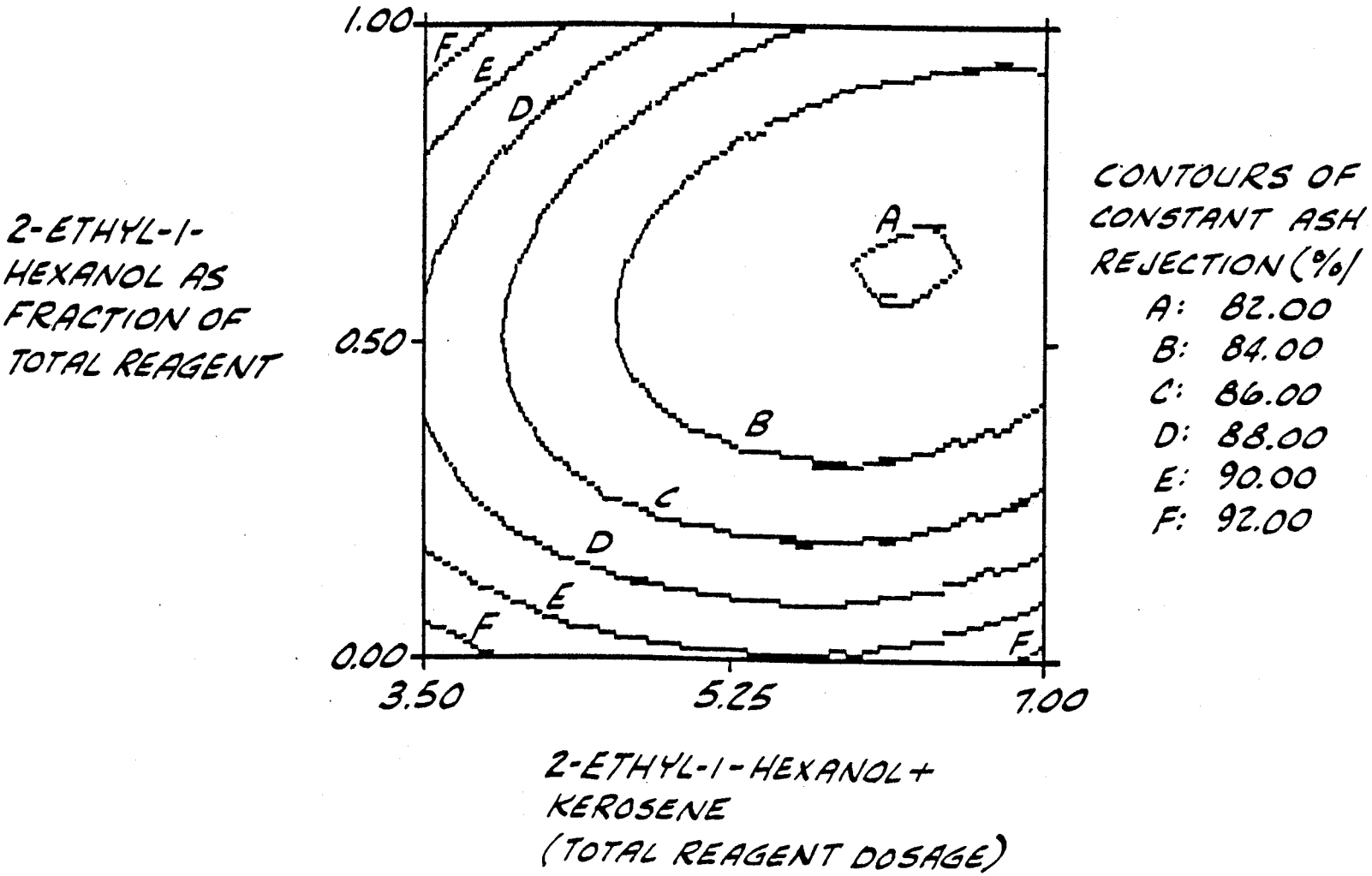
FIG. 13 is a response surface diagram, also based on the 2-ethyl-1-hexanol/kerosene data of Example 7, showing ash rejection as a function of total reagent and the fraction of reagent represented by 2-ethyl-1-hexanol.
Figure 14:
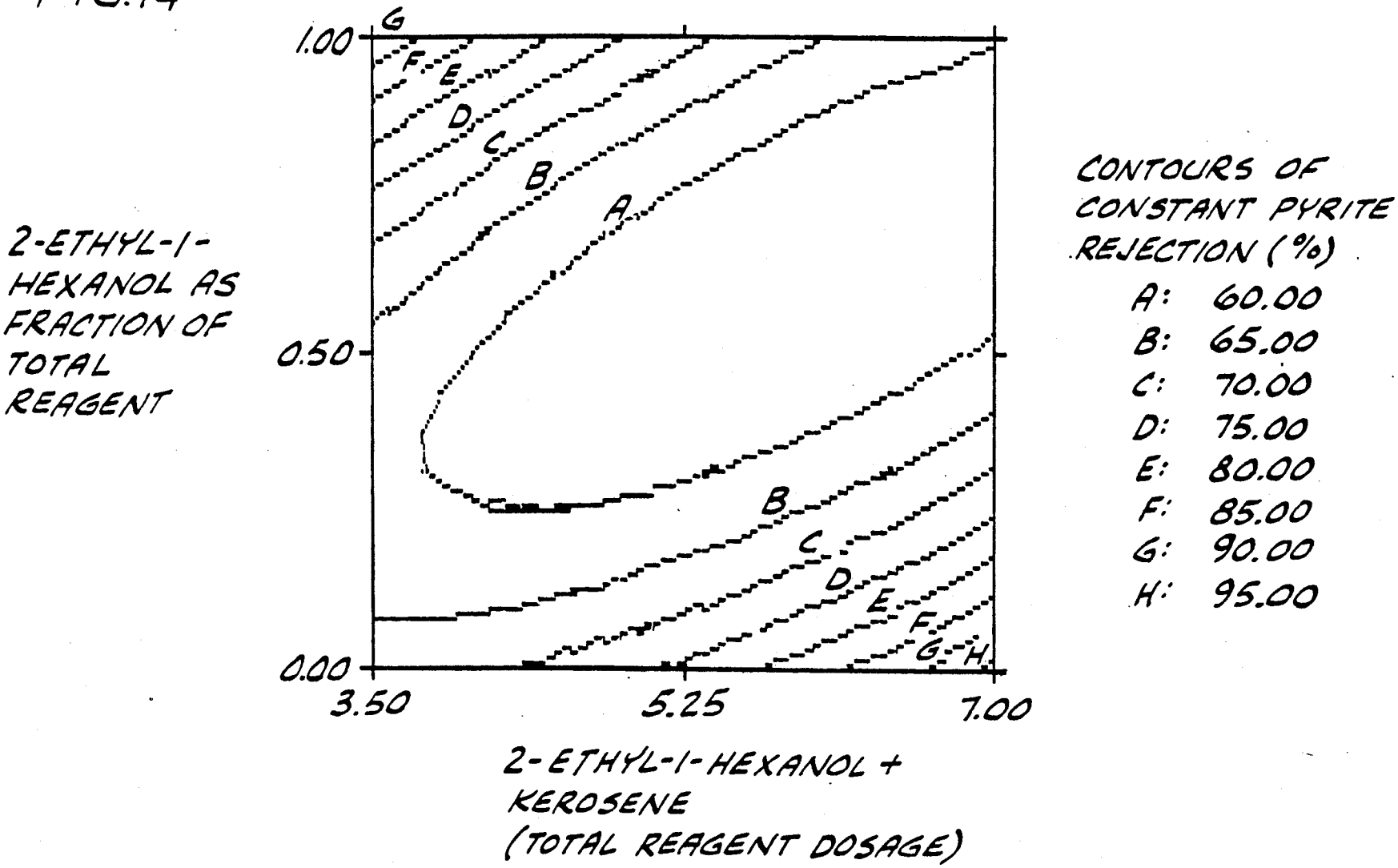
FIG. 14 is a response surface diagram, also based on the 2-ethyl-1-hexanol/kerosene data of Example 7, showing pyrite rejection as a function of total reagent and the fraction of reagent represented by 2-ethyl-1-hexanol.

FIGS. 12–14 are the response surface diagrams for BTU recovery, ash rejection, and pyrite rejection, respectively, as a function of total reagent and fraction of 2-ethyl-1-hexanol, for the comparative tests in which the reagent was constituted of a combination of 2-ethyl-1-hexanol and kerosene.

TABLE 9

Results for Illinois No. 6 (Herrin) Seam Coal Using Surfactants of the Invention and Mixtures of Alcohols Thereof

| | Dosage | Recovery, % | | Ash % | | Pyritic Sulfur, % | | Rejection, % | |
|---|---|---|---|---|---|---|---|---|---|
| Reagent | # A/tds | Wt | Btu | Feed | Product | Feed | Product | Ash | Pyritic S |
| MIBC | 8.4 | 66.8 | 89.6 | 28.4 | 6.9 | 0.76 | 0.36 | 83.8 | 68.3 |
| 2EH | 4.9 | 56.6 | 77.5 | 28.7 | 5.7 | 0.77 | 0.34 | 88.7 | 75.0 |
| 2EH | 5.4 | 65.4 | 86.4 | 26.9 | 6.4 | 0.71 | 0.38 | 84.4 | 65.0 |
| Pine Oil | 6.2 | 69.2 | 93.6 | 28.3 | 5.9 | 0.74 | 0.38 | 85.5 | 64.9 |
| K-4-0-4-S | 1.5 | 54.2 | 72.8 | 27.7 | 7.4 | 0.74 | 0.42 | 85.3 | 68.6 |
| K-4-0-4-S | 1.9 | 64.5 | 85.4 | 27.5 | 6.6 | 0.77 | 0.42 | 84.5 | 64.6 |
| K-4-0-4-S + | 0.5 | 45.9 | 61.5 | 28.0 | 6.5 | 0.80 | 0.38 | 89.3 | 78.3 |
| 2EH | 2.8 | | | | | | | | |
| K-4-4-4-S + | 0.5 | 66.8 | 89.3 | 28.4 | 7.2 | 0.73 | 0.38 | 83.4 | 65.2 |
| 2EH | 1.1 | | | | | | | | |
| K-4-04-4-S + | 0.5 | 66.8 | 89.3 | 28.4 | 7.2 | 0.73 | 0.38 | 83.4 | 65.2 |
| 2EH | 1.4 | | | | | | | | |
| 2EH | 2.8 | | | | | | | | |
| K-4-0-4-S + | 1.0 | 66.1 | 89.3 | 28.5 | 6.7 | 0.72 | 0.35 | 84.4 | 68.2 |
| 2EH | 2.0 | | | | | | | | |
| K-4-0-4-S + | 1.1 | 69.5 | 94.3 | 30.0 | 8.1 | 0.80 | 0.48 | 81.4 | 58.0 |
| 2EH | 1.4 | | | | | | | | |
| K-4-0-4-S + | 1.7 | 69.4 | 92.7 | 28.6 | 7.9 | 0.73 | 0.41 | 80.8 | 61.4 |
| 2EH | 1.0 | | | | | | | | |
| K-4-0-4-S + | 1.7 | 69.6 | 93.1 | 28.8 | 7.8 | 0.71 | 0.38 | 81.0 | 62.9 |
| 2EH | 2.0 | | | | | | | | |
| 2EH + | 3.6 | 68.0 | 92.0 | 28.5 | 6.2 | 0.72 | 0.39 | 85.1 | 63.6 |
| Kerosene | 1.5 | | | | | | | | |
| 2EH + | 4.8 | 70.1 | 95.6 | 28.8 | 6.1 | 0.75 | 0.41 | 85.1 | 61.7 |
| Kerosene | 2.1 | | | | | | | | |
| 2EH + | 2.3 | 48.9 | 67.4 | 28.9 | 5.0 | 0.79 | 0.39 | 91.5 | 77.9 |
| Kerosene | 1.0 | | | | | | | | |
| K-6-D-6-S + | 1.1 | 61.1 | 81.1 | 28.0 | 8.4 | 0.75 | 0.42 | 81.3 | 65.3 |
| 2EH | 1.0 | | | | | | | | |
| K-8-H-8-S + | 1.1 | 18.3 | 24.0 | 28.2 | 8.1 | 0.75 | 0.36 | 94.5 | 91.5 |
| 2EH | 1.0 | | | | | | | | |

TABLE 9-continued

Results for Illinois No. 6 (Herrin) Seam Coal Using Surfactants of the Invention and Mixtures of Alcohols Thereof

| Reagent | Dosage # A/tds | Recovery, % Wt | Recovery, % Btu | Ash % Feed | Ash % Product | Pyritic Sulfur, % Feed | Pyritic Sulfur, % Product | Rejection, % Ash | Rejection, % Pyritic S |
|---|---|---|---|---|---|---|---|---|---|
| K-3-P-3 & 4-S + | 1.1 | 13.1 | 17.2 | 28.1 | 8.1 | 0.79 | 0.38 | 96.2 | 93.7 |
| 2EH | 1.0 | | | | | | | | |
| SLS + | 1.0 | 20.5 | 26.6 | 28.5 | 9.2 | 0.77 | 0.36 | 93.4 | 90.4 |
| 2EH | 1.0 | | | | | | | | |

MIBC = methlisobutylcarbinol; 2EH = 2-ethylhexanol; K-4-0-4-S = $K^+$(E)-4-octene-4-sulfonate; K-6-D-S = $K^+$(E)-6-dodecene-6-sulfonate; K-8-H-8-S = $K^+$(E)-8-hexadecene-8-sulfonate; K-3-P-3 & 4-S = $K^+$(E)-3-pentdecene-3 & 4 sulfonate; SLS = sodium lauryl sulfate In view of the above, it will be seen that the several objects of the invention are achieved and other advantageous results attained.

As various changes could be made in the above processes and compositions without departing from the scope of the invention, it is intended that all matter contained in the above description or shown in the accompanying drawings shall be interpreted as illustrative and not in a limiting sense.

We claim:

1. A process for cleaning of particulate coal and separation therefrom of pyrite and ash, comprising the steps of:

slurrying a particulate coal feed material in an aqueous liquid flotation composition to produce a pulp, said feed material comprising particles of carbonaceous matter, particles comprising pyrite and particles comprising ash, and said aqueous liquid flotation composition containing an anionic surfactant comprising a substituted ethenesulfonic acid or salt thereof;

aerating said pulp to produce bubbles therein, whereby the particles of carbonaceous material contained in the pulp adhere preferentially to the surfaces of the bubbles and are carried by said bubbles to the upper surface of said liquid where a foam of said bubbles is formed, the solids contained within said foam being enriched in said carbonaceous matter, the solids in a zone of the liquid phase below said foam being relatively enriched in pyrite and ash;

separating said foam from the liquid phase comprising said zone; and recovering said carbonaceous matter from said foam.

2. A process as set forth in claim 1 wherein said pulp contains at least about 0.1 pounds of said anionic surfactant per ton of said particulate coal feed material.

3. A process as set forth in claim 1 wherein the total number of carbon atoms in said surfactant is between 2 and about 16.

4. A process as set forth in claim 3 wherein the total number of carbon atoms in said surfactant is not greater than about 12.

5. A process as set forth in claim 4 wherein the total number of carbon atoms in said surfactant is not greater than about 8.

6. A process as set forth in claim 4 wherein each of $R^1$ and $R^2$ is n-pentyl.

7. A process as set forth in claim 4 wherein each of $R^1$ and $R^2$ is n-propyl.

8. A process as set forth in claim 4 wherein said particulate coal is a relatively low rank bituminous coal which contains, on a mineral free basis, no greater than about 69% by weight fixed carbon and at least about 31% by weight volatile matter, and which has a dry calorific value not greater than 14,000 B.T.U. per pound.

9. A process as set forth in claim 8 wherein the total number of carbon atoms in said surfactant is not greater than about 8.

10. A process as set forth in claim 8 wherein each of $R^1$ and $R^2$ is n-pentyl.

11. A process as set forth in claim 8 wherein each of $R^1$ and $R^2$ is n-propyl.

12. A process as set forth in claim 8 wherein said pulp contains at least about 0.15 pounds of said surfactant per ton of said feed material.

13. A process as set forth in claim 8 wherein the particles size of said particulate coal feed material is substantially below 28 mesh, at least about 30% by weight of the particles of said feed material being larger than 100 mesh.

14. A process as set forth in claim 13 wherein said pulp further contains a collector effective for increasing the hydrophobicity of said carbonaceous matter, thereby enhancing the selectivity of adherence of said carbonaceous matter to said bubbles preferentially to adherence thereto of pyrite and ash.

15. A process as set forth in claim 14 wherein said pulp initially contains between about 3% and about 25% by weight of said particulate coal feed material.

16. A process as set forth in claim 15 wherein said pulp initially contains between about 6% and about 12% by weight of said particulate coal feed material.

17. A process as set forth in claim 8 wherein at least about 75% by weight of said particulate feed material is smaller than 400 mesh.

18. A process as set forth in claim 17 wherein said pulp contains at least about 0.5 pounds of said anionic surfactant per ton of said particulate feed material.

19. A process as set forth in claim 17 wherein said surfactant and the conditions of aeration are such as to provide an average bubble diameter of not greater than about 1,000 microns in said foam.

20. A process as set forth in claim 19 wherein said slurry initially contains between about 2% and about 10% by weight of said particulate coal feed material.

21. A process as set forth in claim 3 wherein each of $R^1$ and $R^2$ is n-heptyl.

22. A process as set forth in claim 1 wherein the particle size of said particulate coal feed material is substantially below 28 mesh, at least about 30% by weight of the particles of said feed material being larger than 100 mesh.

23. A process as set forth in claim 1 wherein at least about 75% by weight of said particulate feed material is smaller than 400 mesh.

24. A process as set forth in claim 23 wherein said pulp contains at least about 0.4 lbs of said anionic surfactant per ton of said particulate feed material.

25. A process as set forth in claim 23 wherein at least about 75% by weight of said particulate feed material is smaller than 400 mesh.

26. A process as set forth in claim 1 wherein said anionic surfactant has the structural formula

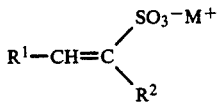

wherein $R^1$ and $R^2$ are independently selected from the group consisting of hydrogen and hydrocarbon substituents, and M is a cation selected from the group consisting of hydrogen, metal, ammonium and alkylated ammonium.

27. A process a set forth in claim 26 wherein each of $R^1$ and $R^2$ is alkyl.

28. A process as set forth in claim 27 wherein $R^1$ and $R^2$ are in cis-relationship to each other.

29. A process as set forth in claim 1 wherein said pulp further contains a collector effective for increasing the hydrophobicity of said carbonaceous matter, thereby enhancing the selectivity of adherence of said carbonaceous matter to said bubbles preferentially to adherence thereto of pyrite and ash.

30. A process as set forth in claim 29 wherein collector comprises kerosene.

31. A process as set forth in claim 1 wherein said particulate coal feed material is first slurried in water, said surfactant is thereafter added to said slurry, dissolving in the aqueous liquid phase to provide said liquid flotation composition, and the resulting pulp is agitated while air is introduced below the liquid surface to produce said bubbles.

32. A process as set forth in claim 1 wherein said aqueous liquid flotation composition contains an anionic surfactant and a nonionic frothing agent in relative proportions of between about one part by weight anionic surfactant per three parts by weight nonionic frothing agent and about four parts by weight anionic surfactant per part by weight nonionic frothing agent.

33. A process as set forth in claim 32 wherein said nonionic frothing agent is selected from the group consisting of alcohols, terpinols, phenolics, glycols, polyglycols, ethers, and alkanolamides.

34. A process as set forth in claim 33 wherein said nonionic frothing agent is selected from the group consisting of methylisobutylcarbinol, 2-ethyl-1-hexanol, pine oil, cresol, and 1,1,3-triethoxybutane.

35. A process as set forth in claim 32 wherein the sum of proportions of said anionic surfactant and said nonionic frothing agent constitutes at least about 0.15 pounds per ton of particulate coal feed material.

* * * * *